US011542651B2

(12) United States Patent
Cho et al.

(10) Patent No.: US 11,542,651 B2
(45) Date of Patent: Jan. 3, 2023

(54) CLOTHES CARE APPARATUS

(71) Applicant: SAMSUNG ELECTRONICS CO., LTD., Suwon-si (KR)

(72) Inventors: Hwangmook Cho, Suwon-si (KR); Hyunjoo Kim, Suwon-si (KR); Dongwoo Shin, Suwon-si (KR); Geonung Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 57 days.

(21) Appl. No.: 17/104,375

(22) Filed: Nov. 25, 2020

(65) Prior Publication Data

US 2021/0156071 A1 May 27, 2021

(30) Foreign Application Priority Data

Nov. 26, 2019 (KR) ..... 10-2019-0153101

(51) Int. Cl.
*D06F 58/10* (2006.01)
*D06F 58/20* (2006.01)
*D06F 73/02* (2006.01)

(52) U.S. Cl.
CPC ..... *D06F 58/10* (2013.01); *D06F 58/203* (2013.01); *D06F 73/02* (2013.01); *D06F 58/206* (2013.01)

(58) Field of Classification Search
CPC ..... D06F 58/20; D06F 58/203; D06F 73/02; D06F 58/10; D06F 58/206
See application file for complete search history.

(56) References Cited

U.S. PATENT DOCUMENTS 6,189,346 B1 * 2/2001 Chen ..... D06F 73/02 68/5 R
2003/0126691 A1 * 7/2003 Gerlach ..... D06F 58/10 8/158
2005/0223502 A1 * 10/2005 Kleker ..... D06F 58/10 68/5 R
2006/0101867 A1 * 5/2006 Kleker ..... D06F 58/10 68/5 R (Continued)

FOREIGN PATENT DOCUMENTS

KR 10-2012-0074557 7/2012
KR 10-2014-0004957 1/2014

(Continued)

OTHER PUBLICATIONS

International Search Report dated Apr. 8, 2021 in International Patent Application No. PCT/KR2020/016716.

*Primary Examiner* — Benjamin L Osterhout
(74) *Attorney, Agent, or Firm* — Staas & Halsey LLP

(57) ABSTRACT

Disclosed herein is a clothes care apparatus capable of performing clothes care using an airflow. The clothes care apparatus includes a main body including a clothes care compartment in which clothes is accommodated, a blower provided in the main body and configured to generate an airflow, a blowing flow path configured to guide the airflow supplied from the blower to the clothes, a plurality of nozzles disposed on the blowing flow path, each nozzle including an airflow outlet configured to discharge the airflow to an inside of the clothes care compartment, and at least one blocking member disposed on the blowing flow path to block an airflow supplied to the clothes care compartment.

20 Claims, 18 Drawing Sheets

(56) References Cited

U.S. PATENT DOCUMENTS

| | | | | |
|---|---|---|---|---|
| 2009/0133298 | A1* | 5/2009 | Kim | D06F 73/02 223/51 |
| 2012/0160269 | A1* | 6/2012 | Pyo | D06F 58/203 134/25.1 |
| 2018/0334767 | A1* | 11/2018 | Kim | H04N 5/225 |

FOREIGN PATENT DOCUMENTS

| | | |
|---|---|---|
| KR | 10-2016-0143295 | 12/2016 |
| KR | 10-2017-0102589 | 9/2017 |
| KR | 10-2018-0006000 | 1/2018 |
| KR | 10-1867505 | 6/2018 |
| KR | 10-2019-0041170 | 4/2019 |
| KR | 10-1999533 | 10/2019 |

* cited by examiner

CLOTHES CARE APPARATUS

CROSS-REFERENCE TO RELATED APPLICATION(S)

This application is based on and claims priority under 35 U.S.C. § 119 to Korean Patent Application No. 10-2019-0153101, filed on Nov. 26, 2019, in the Korean Intellectual Property Office, the disclosure of which is incorporated by reference herein in its entirety.

BACKGROUND

1. Field

The disclosure relates to a clothes care apparatus, more particularly to a clothes care apparatus capable of performing clothes care using an airflow.

2. Description of Related Art

In general, a clothes care apparatus refers to a device that performs washing or drying laundry. In the clothes care apparatus, a clothes care apparatus having a drying function is provided with a hot air supplier that supplies hot air to an accommodation space where clothes are accommodated for drying, and a steam generator configured to perform a refresh function such as crease removal, deodorization, and static removal of clothes.

The clothes care apparatus is configured in the form of a cabinet in which a storage compartment for storing clothes is formed. The storage compartment for storing clothes is formed in an upper portion of the cabinet and an electronics compartment, in which a steam generator or a hot air supplier is placed, is formed under the storage compartment. The storage compartment and the electronics compartment may be separated by a partition wall.

The clothes care apparatus may include a clothes support member provided in the storage compartment for hanging the clothes. The clothes care apparatus may perform clothes care by translational and/or rotational movement of the clothes support member, or perform the clothes care by providing an airflow to the clothes support member.

SUMMARY

In accordance with an aspect of the disclosure, a clothes care apparatus includes a main body including a clothes care compartment in which clothes is accommodated, a blower provided in the main body and configured to generate an airflow, a blowing flow path configured to guide the airflow supplied from the blower to the clothes, a plurality of nozzles disposed on the blowing flow path, each nozzle including an airflow outlet configured to discharge the airflow to an inside of the clothes care compartment, and at least one blocking member disposed on the blowing flow path to block an airflow supplied to the clothes care compartment.

The blocking member may include a body including a hollow portion disposed on the blowing flow path, the body removably coupled to the plurality of nozzles, and a blocking cover configured to block the hollow portion of the body so as to block the airflow flowing through the blowing flow path.

The blocking cover may be integrally formed with one end of the body.

The clothes care apparatus may further include at least one clothes support member disposed on the blowing flow path, and removably coupled to the plurality of nozzles, and the blocking member may be coupled to at least one of the plurality of nozzles, and the clothes support member may be coupled to at least one of the plurality of nozzles to which the blocking member is not coupled.

The blocking member may be rotatably disposed on the nozzle so as to block an airflow flowing through the blowing flow path.

The blocking member may include a rotating shaft provided with a handle provided on one end of the rotating shaft, the rotating shaft rotatably coupled to the nozzle, and the blocking member may open and close the blowing flow path by being rotated in response to a rotation of the handle.

The blocking member may include a rotating shaft rotatably coupled to the nozzle, and a torsion device configured to apply a torque to one end of the rotating shaft to allow the blocking member to be rotated may be provided.

The clothes care apparatus may further include at least one clothes support member disposed on the blowing flow path, and removably coupled to the plurality of nozzles, and the torsion device may be configured to apply a torque to allow the blocking member to be rotated in one direction, the nozzle may further include a stopper provided on one end of the nozzle and configured to stop the blocking member, and the clothes support member may include a rotation protrusion configured to press the blocking member to rotate the blocking member to a direction opposite to the one direction in response to coupling the clothes support member to the nozzle.

The clothes care apparatus may further include at least one clothes support member disposed on the blowing flow path, and removably coupled to the nozzle.

The blocking member may be rotatably disposed on the clothes support member to block an airflow flowing through the blowing flow path.

The blocking member may include a rotating shaft provided with a handle provided on one end of the rotating shaft, the rotating shaft rotatably coupled to the nozzle, and the blocking member may open and close the blowing flow path by being rotated in response to a rotation of the handle.

In accordance with another aspect of the disclosure, a clothes care apparatus includes a main body including a clothes care compartment in which clothes is accommodated, a blower provided in the main body and configured to generate an airflow, a blowing flow path configured to guide the airflow generated by the blower to an inside of the clothes care compartment, and a blocking member rotatably disposed on the blowing flow path to block an airflow supplied to an inside of the clothes care compartment. The blowing flow path includes a first flow path formed in a nozzle plate provided at one side of the clothes care compartment, and a second flow path formed in an inside of the clothes support member removably coupled to the nozzle plate.

The blocking member may include a rotating shaft provided on a center of the blocking member, and the blocking member may be rotatably provided on the nozzle plate to block the first flow path.

The rotating shaft may be provided with a handle provided on one end of the rotating shaft, and the blocking member may open and close the first flow path by being rotated in response to a rotation of the handle.

The blocking member may include a torsion device provided at one end of the rotating shaft to apply a torque to the rotating shaft so as to allow the blocking member to be rotated.

The blocking member may include a rotating shaft provided on a center of the blocking member, and the blocking member may be rotatably provided in an inside of the clothes support member to block the second flow path.

The rotating shaft may be provided with a handle provided on one end of the rotating shaft, and the blocking member may open and close the second flow path by being rotated in response to a rotation of the handle.

In accordance with another aspect of the disclosure, a clothes care apparatus includes a main body including a clothes care compartment, a blower provided on an outside of the clothes care compartment and configured to generate an airflow, at least one clothes support member disposed in an inside of the clothes care compartment and provided with a flow path therein, a nozzle plate including a plurality of openings to allow the airflow generated by the blower to flow into the clothes support member, and at least one blocking member configured to close the opening and removably coupled to the nozzle plate. The clothes support member is removably coupled to the nozzle plate to communicate with the opening.

The blocking member may include a body including a hollow portion configured to communicate with the opening, the body removably coupled to the nozzle plate, and a blocking cover configured to block the hollow portion of the body to close the opening.

The blocking member may be provided in such a way that the blocking cover is integrally formed with one end of the body.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of embodiments, taken in conjunction with the accompanying drawings of which:

FIG. 3 is a side cross-sectional view of the clothes care apparatus shown in

FIG. 1;

FIG. 4 is an exploded view illustrating the clothes care apparatus shown in

FIG. 1;

DETAILED DESCRIPTION

Figure 1:
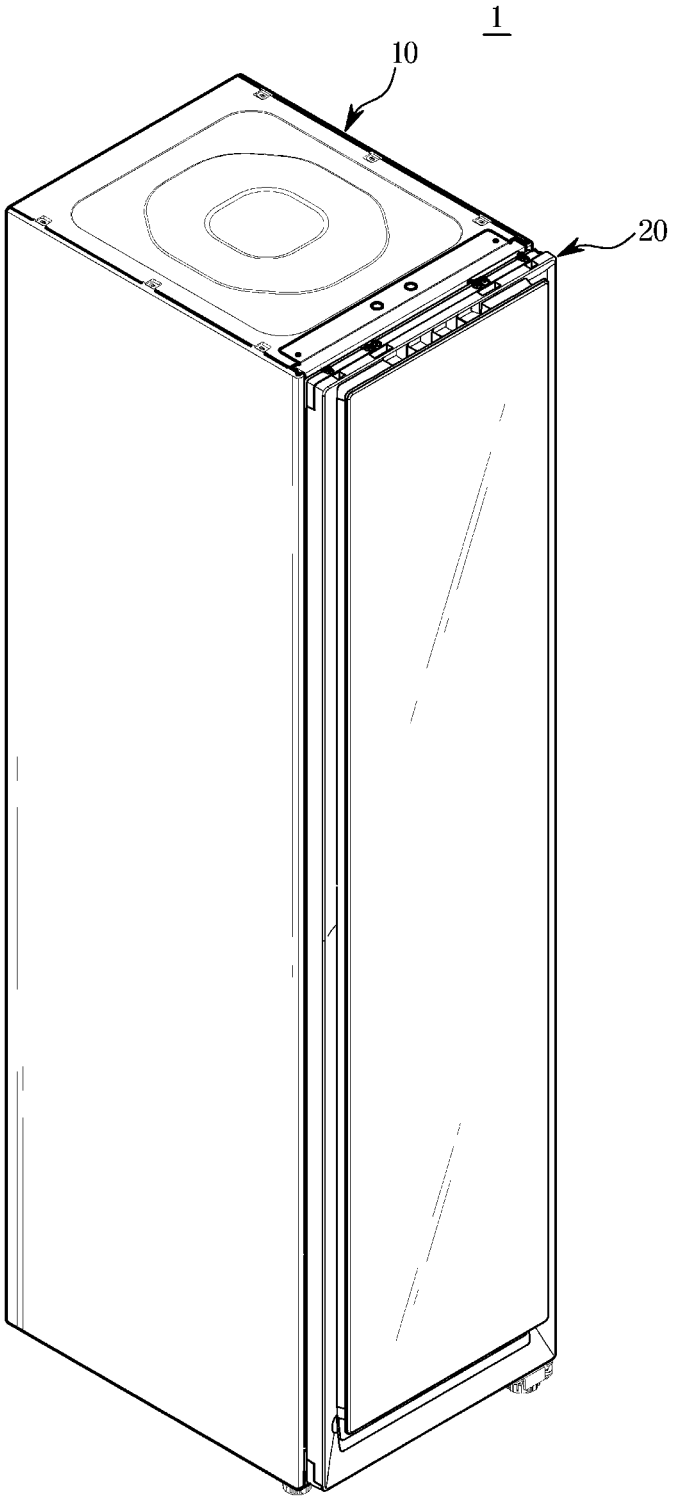
FIG. 1 is a view of a clothes care apparatus according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

Parts which are not associated with the description are omitted in order to particularly describe the disclosure, and like reference numerals refer to like elements throughout the specification.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "upper end", "lower end", "front side", "rear side" and the like may be defined by the drawings, but the shape and the location of the component is not limited by the term.

It is an aspect of the disclosure to provide a clothes care apparatus capable of providing an airflow to an inside and outside of clothes.

It is another aspect of the disclosure to provide a clothes care apparatus capable of appropriately distributing and providing an airflow to a plurality of clothes support members.

It is another aspect of the disclosure to provide a clothes care apparatus capable of reducing loss of airflow supplied to a clothes support member.

Figure 2:
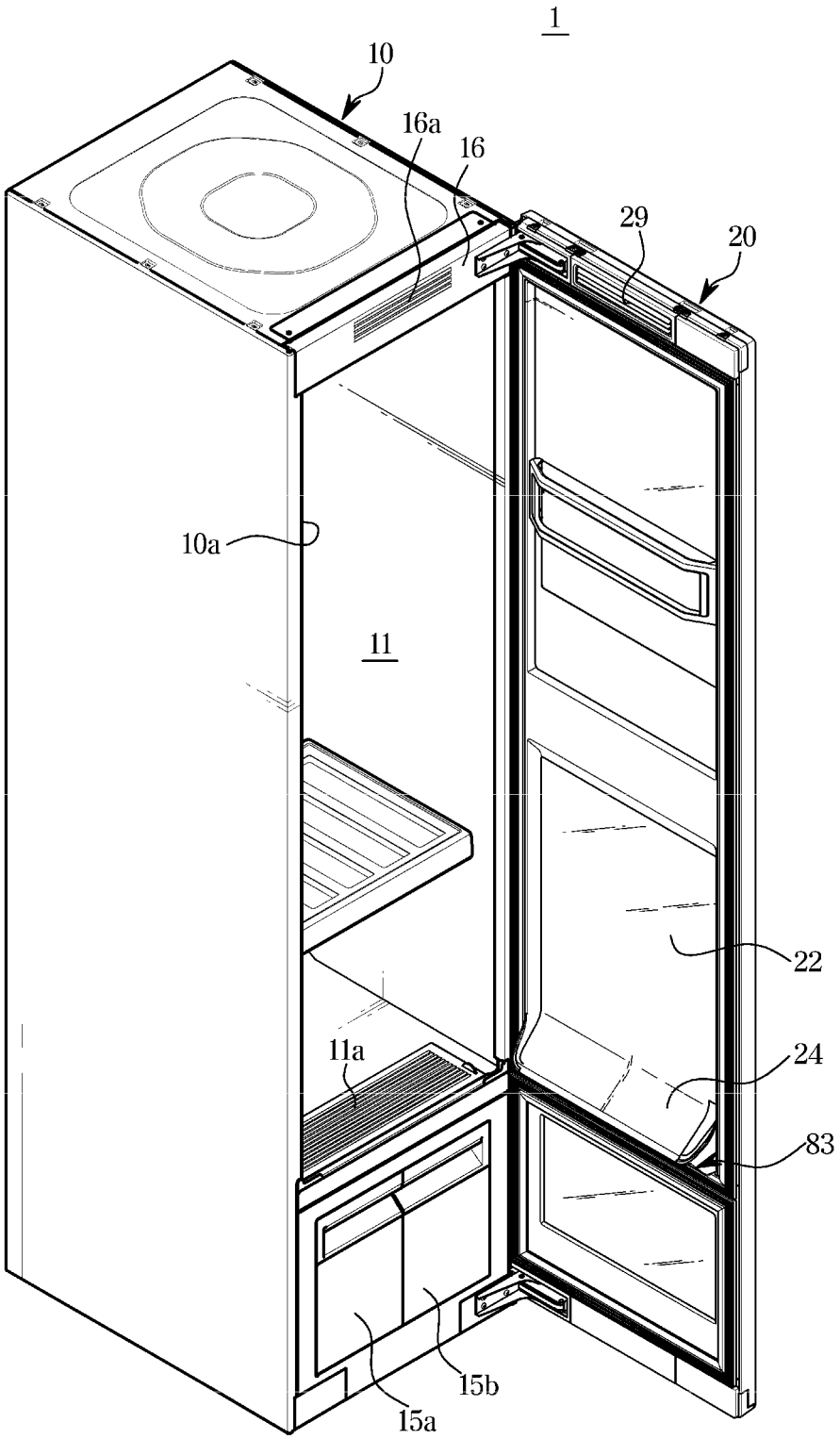
FIG. 2 is a view illustrating a state in which a door of the clothes care apparatus shown in FIG. 1 is opened.
Figure 3:
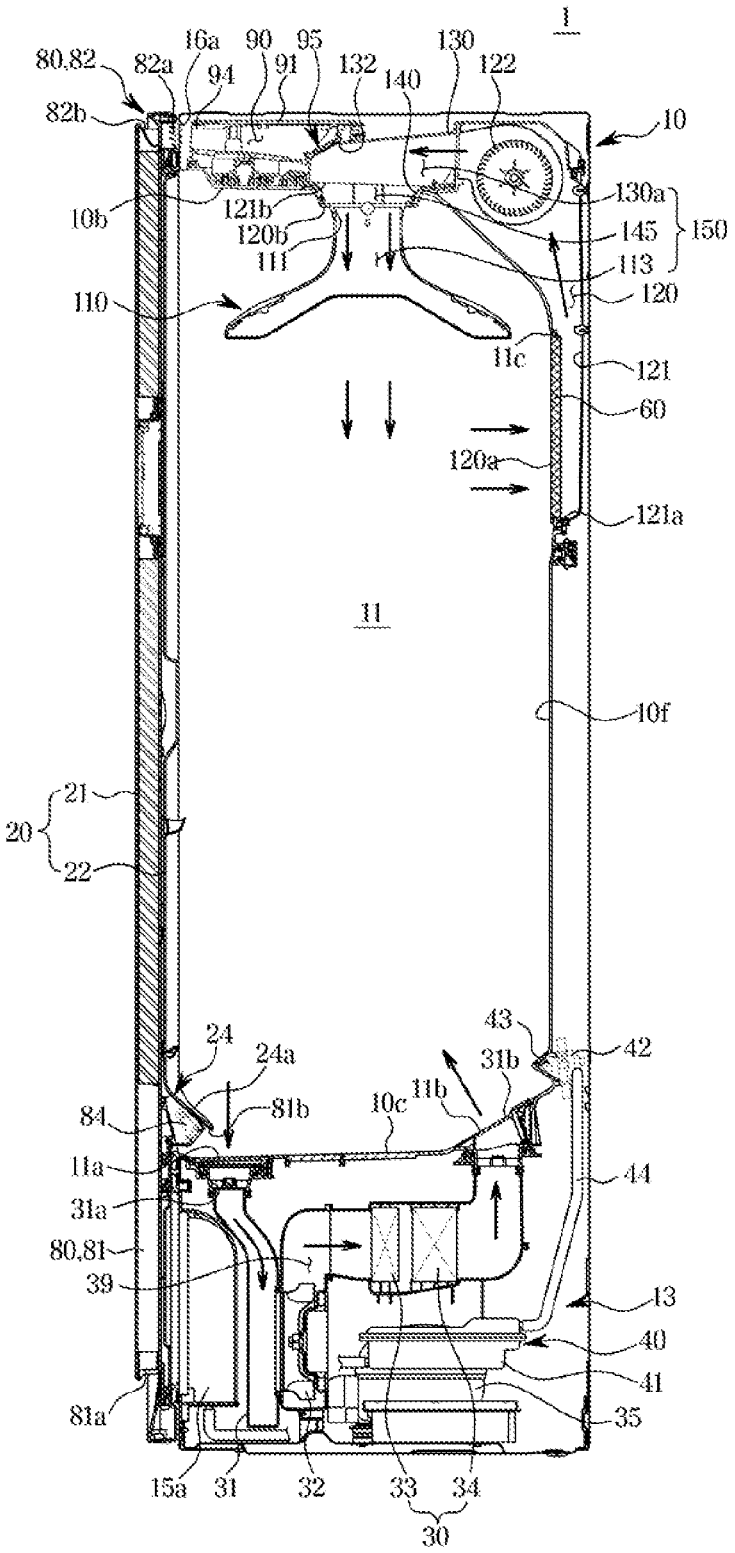
Figure 4:
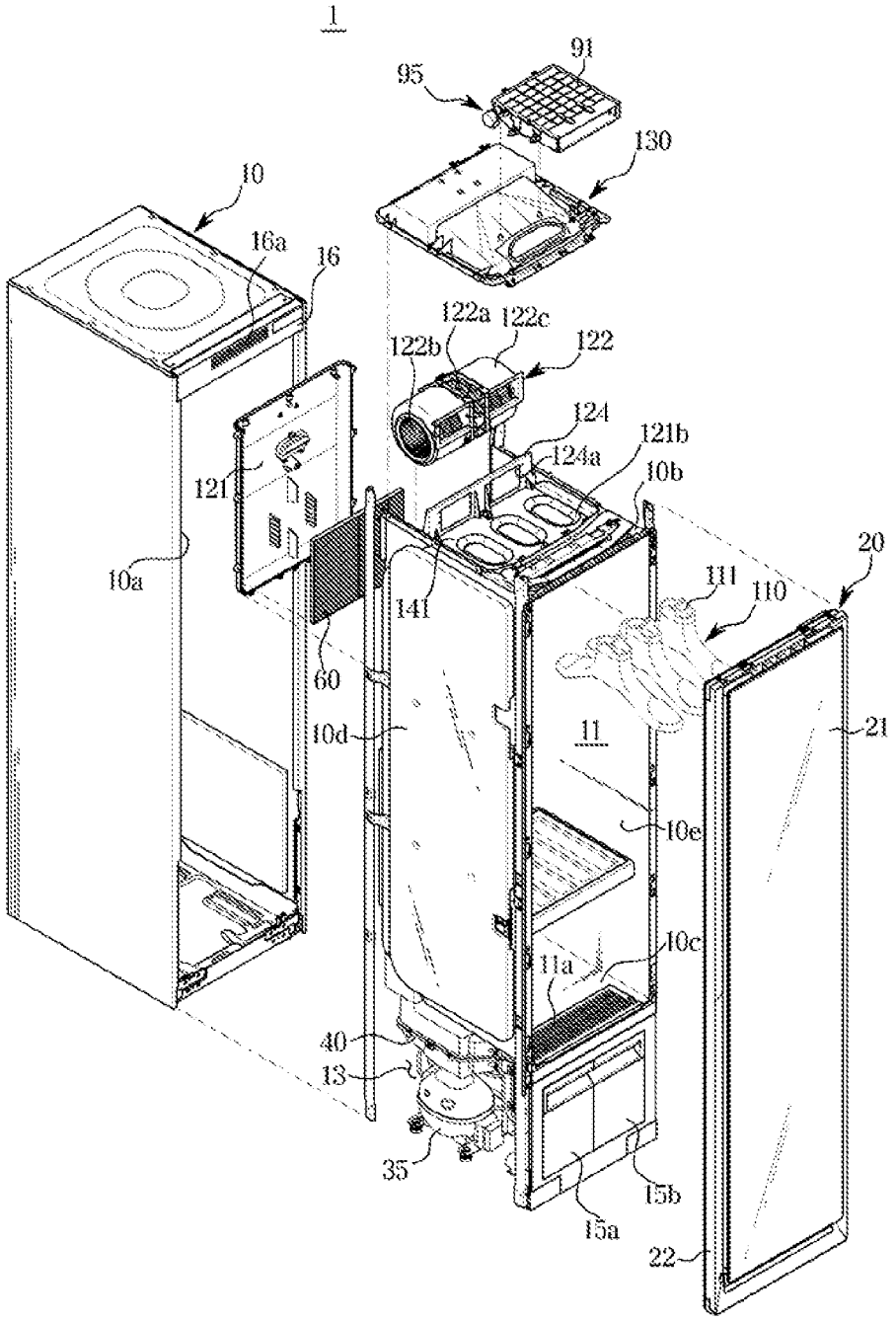
Figure 5:
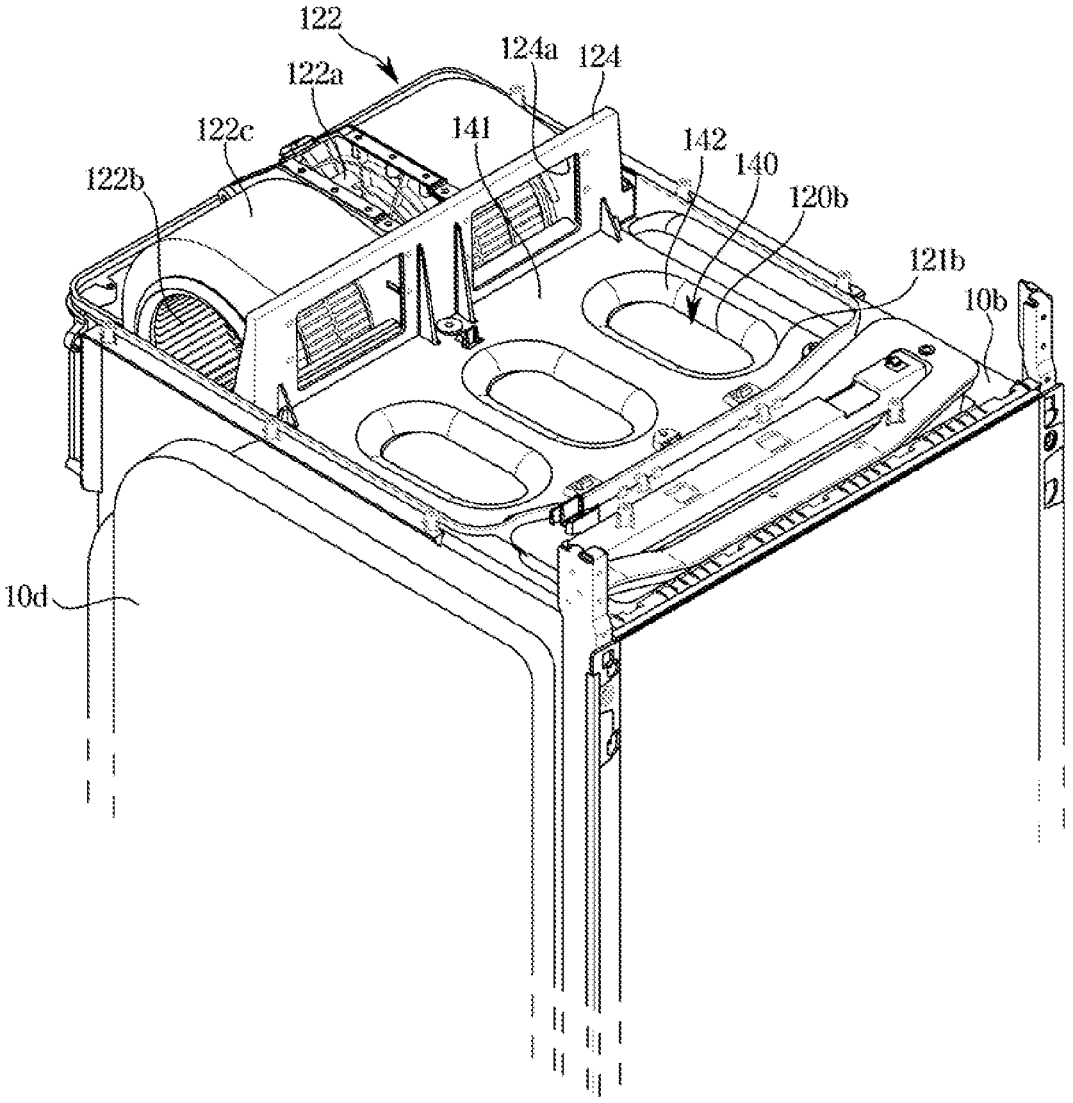
FIG. 5 is a view illustrating a guide flow path of a second circulation flow path formed inside a top cover of the clothes care apparatus illustrated in FIG. 1.
Figure 6:
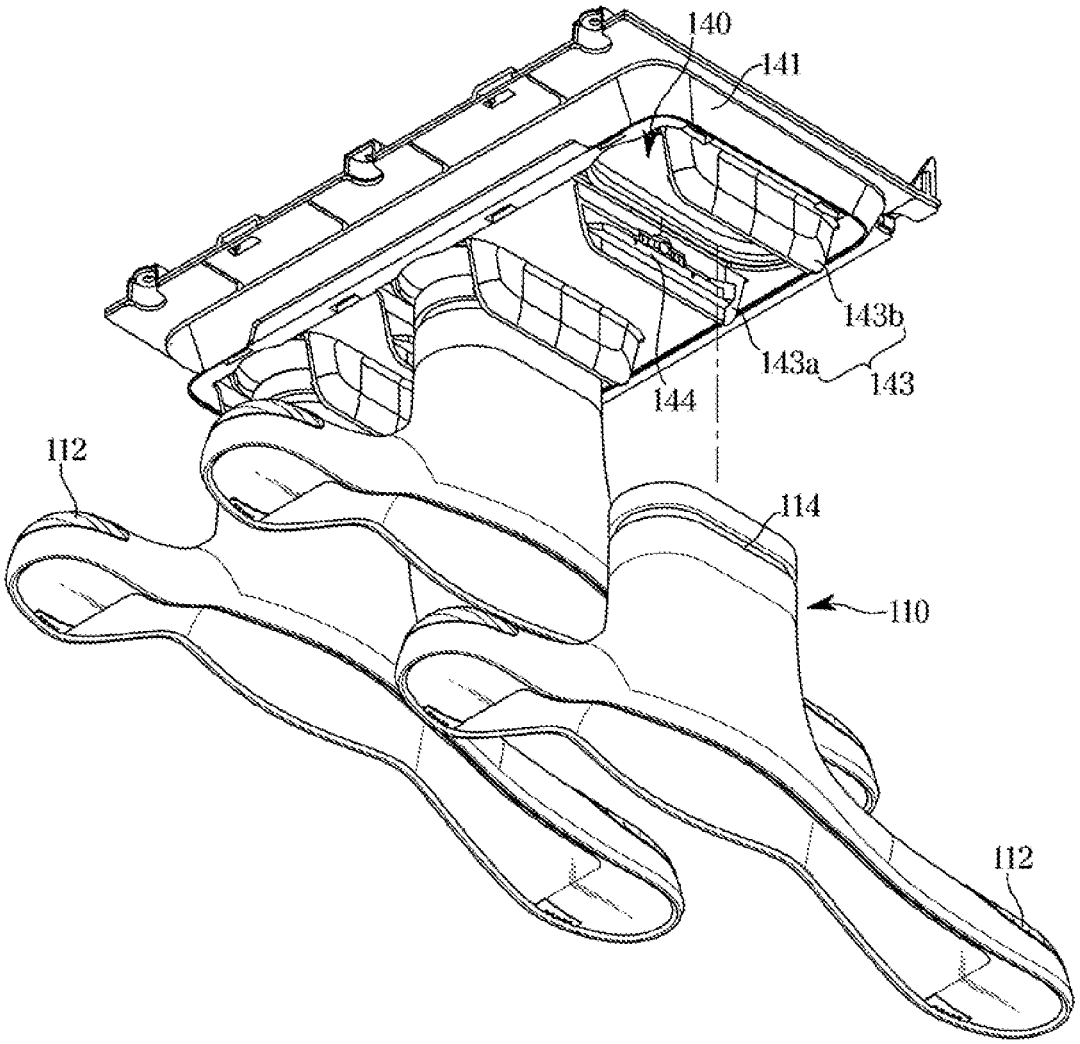
FIG. 6 is an exploded view illustrating a part of a clothes support member disposed in the clothes care apparatus shown in FIG. 1.
Figure 7:
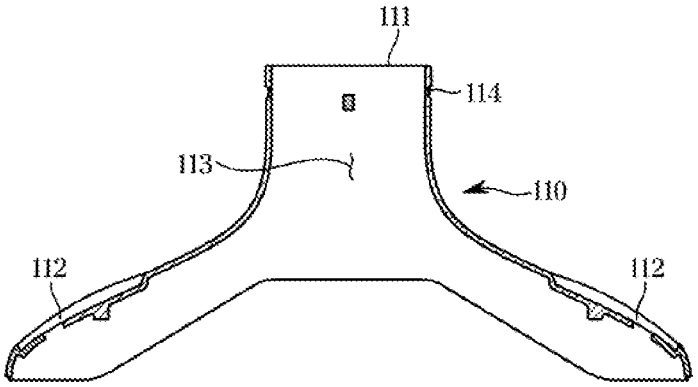
FIG. 7 is a cross-sectional view illustrating a cross section of the clothes support member shown in FIG. 6.

FIG. 1 is a view of a clothes care apparatus according to an embodiment of the disclosure. FIG. 2 is a view illustrating a state in which a door of the clothes care apparatus shown in FIG. 1 is opened. FIG. 3 is a side cross-sectional view of the clothes care apparatus of FIG. 1. FIG. 4 is an exploded view illustrating the clothes care apparatus shown in FIG. 1. FIG. 5 is a view illustrating a guide flow path of a second circulation flow path formed inside a top cover of the clothes care apparatus illustrated in FIG. 1. FIG. 6 is an exploded view illustrating a part of a clothes support member disposed in the clothes care apparatus shown in FIG. 1. FIG. 7 is a cross-sectional view illustrating a cross section of the clothes support member shown in FIG. 6.

Referring to FIGS. 1 to 7, a clothes care apparatus 1 may include a main body 10 and a door 20 rotatably coupled to main body 10. A clothes care compartment 11 in which clothes is placed and clothes care is performed may be provided inside the main body 10.

The clothes care apparatus 1 may include a blower 122 configured to generate an airflow to be introduced to the inside of the clothes care compartment 11, and a nozzle 140 configured to allow the airflow generated by the blower 122 to flow into the clothes care compartment 11.

The clothes care apparatus 1 may include a clothes support member 110 provided inside the clothes care compartment 11 and configured to allow clothes to be hung thereon.

The clothes care apparatus 1 may include a machine room 13 provided with a heat exchanger 30 configured to dehumidify or heat air inside the clothes care compartment 11.

The clothes care compartment 11 may be formed in the main body 10, and the clothes care compartment 11 may have a hexahedron shape having an open one surface. An opening 10*a* may be formed on the front surface of the main body 10. The door 20 configured to be rotatable to open and close the opening 10*a* of the main body 10 may be installed in the main body 10. Although not shown, the door 20 may be installed through a connecting member such as a hinge and a link.

The clothes care compartment 11 forms a space in which clothes is accommodated. The clothes care compartment 11 may include an upper surface 10*b*, a lower surface 10*c*, a left side surface 10*d*, a right side surface 10*e*, and a rear surface 10*f* provided in the inside of the main body 10. An opening is formed on a front surface of the clothes care compartment 11. Therefore, the opening of the clothes care compartment 11 may also be opened and closed by the door 20 configured to open and close the opening 10*a* of the main body 10.

A discharge bracket 16 installed at a position corresponding to a discharge flow path 29 of the door 20 to be described later may be provided at an upper end of the opening 10*a* of the main body 10. The discharge bracket 16 may include a plurality of discharge slits 16*a* disposed to correspond to the discharge flow path 29 of the door 20.

The clothes care compartment 11 may include a first airflow inlet 11*a*, a second airflow inlet 120*a*, a first airflow outlet 11*b*, a second airflow outlet 120*b*, and a steam outlet 43. The first airflow inlet 11*a* and the first airflow outlet 11*b* may be formed on the lower surface 10*c* of the clothes care compartment 11. The first airflow inlet 11*a* may be arranged in front of the lower surface 10*c* of the clothes care compartment 11. The first airflow outlet 11*b* may be arranged behind the lower surface 10*c* of the clothes care compartment 11.

The first airflow inlet 11*a* and the first airflow outlet 11*b* may be arranged adjacent to each other.

The steam outlet 43 may be disposed in a lower portion of the rear surface 10*f* of the clothes care compartment 11. The steam outlet 43 may be disposed above the first airflow outlet 11*b*.

The second airflow inlet 120*a* may be formed at an upper portion of the rear surface 10*f* of the clothes care compartment 11. The second air flow outlet 120*b* may be formed at a substantially central portion of the upper surface 10*b* of the clothes care compartment 11. The second airflow inlet 120*a* and the second airflow outlet 120*b* may be arranged adjacent to each other.

In the lower portion of the main body 10, a water drain tank 15*a* and a water supply tank 15*b* removably installed to the main body 10 may be installed. The water drain tank 15*a* and the water supply tank 15*b* may be arranged under the clothes care compartment 11. The water drain tank 15*a* may be configured to easily manage condensed water. The water supply tank 15*b* may store water needed for generating steam for a steam generation device 40. Water stored in the water supply tank 15*b* may be supplied to the steam generation device 40 to form steam. The water supply tank 15*b* may be removably installed to the main body 10 to easily supplement water.

The water drain tank 15*a* and the water supply tank 15*b* may be provided in front of the machine room 13. The machine room 13 may be under the clothes care compartment 11. The machine room 13 may include a heat exchanger 30 configured to dehumidify and heat air in the clothes care compartment 11 as needed.

A first fan 32, the heat exchanger 30, and the steam generation device 40 may be arranged in the machine room 13.

The heat exchanger 30 is installed to supply hot air into the clothes care compartment 11. The heat exchanger 30 includes an evaporator 33, through which a refrigerant circulates, a compressor 35 and a condenser 34, and the heat exchanger 30 is configured to dehumidify and heat the air.

As the refrigerant evaporates in the evaporator 33 of the heat exchanger 30, the refrigerant absorbs latent heat of the ambient air so as to condense and remove moisture in the air. In addition, when the refrigerant is condensed in the condenser 34 by passing through the compressor 35, the latent heat is released toward the ambient air to heat the ambient air. That is, the evaporator 33 and the condenser 34 serve as heat exchangers, and the air, which flows into the machine room 13 by the first fan 32, is dehumidified and heated while passing through the evaporator 33 and the condenser 34 sequentially.

The heat exchanger 30 installed in the machine room 13 may include a first duct 31 configured connect the evaporator 33 and the condenser 34 and the first fan 32, and thus the first duct 31 may be connected to the clothes care compartment 11 so as to form a first circulation flow path 39 configured to circulate between the clothes care compartment 11 and the first duct 31.

The first duct 31 may be connected to the first airflow inlet 11*a* and the first airflow outlet 11*b* of the clothes care compartment 11. One end of the first duct 31 may be connected to the first airflow inlet 11*a* of the clothes care compartment 11, and the other end of the first duct 31 may be connected to the first airflow outlet 11*b* of the clothes care compartment 11. A first duct inlet 31*a* of the first duct 31 may be connected to the first airflow inlet 11*a* and a first duct outlet 31*b* may be connected to the first airflow outlet 11*b*.

Air in the clothes care compartment 11 may be introduced into the first duct 31 through the first airflow inlet 11*a*. The first duct 31 may dehumidify the introduced air and then discharge the dehumidified air to the clothes care compartment 11 through the first airflow outlet 11*b*. According to an embodiment, it is assumed that the first airflow inlet 11*a* is arranged in the front portion of the clothes care compartment 11 and the first airflow outlet 11*b* is arranged in the rear portion of the clothes care compartment 11, but is not limited thereto. Therefore, a location of the airflow inlet and the airflow outlet may vary, as needed.

The first duct 31 is configured to dehumidify the air flowing through the first airflow inlet 11*a*, and to discharge the dehumidified air to the first airflow outlet 11*b*. The first fan 32 is installed on the first duct 31 to suck the air of the clothes care compartment 11 into the first duct 31.

The machine room 40 may further include the steam generation device 40 configured to generate steam by receiving water from the water supply tank 15*b*. The steam generation device 40 may include a steam generator 41 connected to the water supply tank 15*b* to receive the water so as to generate steam, and a steam supply pipe 44 configured to guide the generated steam to a steam injector 42. The steam injector 42 may be arranged in a lower portion of the rear surface of the clothes care compartment 11. A heater (not shown) may be installed inside the steam generator 41 so as to heat water.

The clothes care apparatus 1 may include a dehumidification flow path 80 provided in the door 20 so as to connect the clothes care compartment 11 to the outside during indoor dehumidification is performed. The dehumidification flow path 80 may be provided in the door 20. At least one dehumidification flow paths 80 may be provided. The door 20 may include the dehumidification flow path 80 configured to allow the clothes care compartment 11 to communicate with the outside.

The door 20 may include a first door member 21 forming a front surface, and a second door member 22 coupled to the first door member 21 to form a rear surface.

The dehumidification flow path 80 may be formed between the first door member 21 and the second door member 22. At least one of the dehumidification flow paths 80 may be formed between the first door member 21 and the second door member 22. The dehumidification flow path 80 may be formed in at least one of the first door member 21 and the second door member 22.

The dehumidification flow path 80 may include an inlet flow path 81 configured to suck outside air to the inside of the clothes care compartment 11 and an outlet flow path 82 configured to discharge the internal air of the clothes care compartment to the outside.

The first door member 21 is formed in a plate shape. The first door member 21 may include a mirror, a glass, or a panel. Although the first door member 21 of the clothes care apparatus 1 of FIG. 1 is illustrated as a plate-shaped mirror, the disclosure is not limited thereto. Alternatively, the first door member may include a cover formed of various materials that are coupled to have a sense of unity with furniture in the room where the clothes care apparatus 1 is installed.

The first door member 21 may be installed in front of the second door member 22 to form the exterior of the clothes care apparatus 1.

The inlet flow path 81 is allowed air, which is introduced through a first inlet 81*a*, to move and to be discharged to the clothes care compartment 11 through a first outlet 81*b*.

The inlet flow path 81 may include an inlet flow path duct 83 configured to guide the air, which is introduced through the first inlet 81*a*, to move. The first outlet 81*b* may be formed in the inlet flow path duct 83.

The inlet flow path 81 may include a first damper 84 configured to open and close the first outlet 81*b*. The first damper 84 may be provided inside the inlet flow path duct 83. The inflow flow path duct 83 includes the first damper 84 configured to open and close the first outlet 81*b*.

The door 20 may include a condensate guide 24 configured to guide the movement of condensed water. The condensate guide 24 may be configured to guide condensed water formed by condensation on the rear surface of the door 20. The condensate guide 24 may include a curved portion 24*a* formed to be inclined downward from the rear surface of the door 20 toward the clothes care compartment 11.

The curved portion 24*a* of the condensate guide 24 may include at least one surface of the inlet flow path duct 83. The curved portion 24*a* of the condensate guide 24 may form an upper surface of the inlet flow path duct 83.

The outlet flow path 82 may be allowed air, which is introduced through the second inlet 82*a*, to move and to be discharged to the outside of the clothes care compartment 11 through a second outlet 82*b*. The outlet flow path 82 may be provided in the door 20 so as to discharge the internal air of the clothes care compartment 11 to the outside.

The main body 10 may include a connection flow path 90 configured to connect the second circulation flow path 120 to the outlet flow path 82 to deliver the internal air of the clothes care compartment 11 to the outlet flow path 82.

The connection flow path 90 may be formed inside a connection duct 91 and the connection flow path 90 may include the connection duct 91. The connection duct 91 may be coupled to a top cover 130, and the connection flow path 90 may be formed by coupling the connection duct 91 to the top cover 130. The top cover 130 includes a connection flow path hole 132. The connection flow path hole 132 may be formed in front of the top cover 130. The connection duct 91 is formed to be connected to the connection flow path hole 132 of the top cover 130.

The connection flow path 90 may be formed in connection with the second circulation flow path 120. The connection flow path 90 may be formed to be branched from the second circulation flow path 120.

A connection duct outlet 94 connected to the opening 10*a* of the main body 10 may be formed on the front surface of the connection duct 91. The connection duct outlet 94 may be formed on the front side of the connection duct 91 to allow air of the second circulation flow path 120, which is introduced through the connection flow path hole 132, to be introduced to the connection flow path 90 and to move to the opening 10*a* side of the main body 10 through the connection duct outlet 94.

A second damper 95 may be provided inside the connection duct 91 to open and close a space with the second circulation flow path 120. The second damper 95 may be configured to open and close the connection flow path hole 132 of the top cover 130.

The connection duct outlet 94 of the connection duct 91 may be formed to correspond to dehumidification flow path 80 formed in the door 20. The connection duct outlet 94 may be formed to correspond to the outlet flow path 82 of the door 20. The connection duct outlet 94 may be formed at a position corresponding to the second inlet 82*a* of the outlet flow path 82. The connection duct outlet 94 may be arranged to be connected to the second inlet 82*a* of the outlet flow path 82.

The inlet flow path 82 may include the second inlet 82*a* and the second outlet 82*b* formed to discharge air of the clothes care compartment 11, which is introduced through the second inlet 82*a*, to the outside of the main body 10 and the door 20.

The second inlet 82*a* is provided in the second door member 22 of the door 20. The second inlet 82*a* is provided in an upper portion of the second door member 22. The second inlet 82*a* is formed on the rear surface of the second door member 22. The second inlet 82*a* may be formed at a position corresponding to the connection duct outlet 94 of the connection duct 91. The air of the second circulation flow path 120 that is the internal air of the clothes care compartment 11, which is introduced through the second inlet 82*a*, is discharged to the second outlet 82*b*. The second outlet 82*b* is provided on an upper portion of the door 20. The second outlet 82*b* is formed on an upper portion of the second door member 22. The second inlet 82*a* communicates with the second outlet 82*b*. Air of the clothes care compartment 11 flowing into the second circulation flow path 120 may be discharged to the outside of the main body 10 through the connection flow path 90 and the door 20 upon dehumidification of the clothes care compartment 11.

During a dehumidification operation of the clothes care apparatus 1, the clothes care compartment 11 of the main body 10 may communicate with the room through the dehumidification flow path 80 provided in the door 20.

The clothes support member 110 configured to allow clothes to be hung and to be supported, is provided in the clothes care compartment 11. The clothes support member 110 may be installed on the upper surface 10*b* of the clothes care compartment 11. The clothes support member 110 may be removably installed in the clothes care compartment 11. At least one clothes support member 110 may be provided. The clothes support member 110 may be formed in a hanger shape to allow clothes to be hung.

The clothes support member 110 may be provided with a friction member 112 formed of a material such as rubber or silicone to prevent the clothing from sliding upon being hung thereon.

An internal flow path 113 through which air flows is provided in the inside of the clothes support member 110. Dust or foreign substances on the clothes may be removed by the air supplied into the clothes support member 110. The clothes support member 110 may be provided with an air supply port 111 for supplying air to the clothes.

The second airflow outlet 120*b* of the clothes care compartment 11 may communicate with the clothes support member 110. The air discharged through the second airflow outlet 120*b* may be delivered to the clothes support member 110 through the air supply port 111 and delivered to the inside of the clothes hung on the clothes support member 110 or the air discharged through the second airflow outlet 120*b* may be discharged to the outside of the air supply port 111 and then delivered to the outside of the clothes.

The clothes care apparatus 1 shown in FIG. 1 is described that the second airflow outlet 120*b* is arranged above the clothes support member 110, and the air discharged through the second airflow outlet 120*b* is supplied to the inside and the outside of the clothes, but is not limited thereto. For example, the second airflow outlet 120*b* may be formed in various sizes at various positions to inject air into the clothes in various directions.

The clothes care apparatus 1 may include the blower 122 configured to move the internal air of the clothes care compartment 11.

The blower 122 may be arranged at the outside of the upper end of the clothes care compartment 11 to move the air of the clothes care compartment 11. The blower 122 may include a blower motor 122*a* configured to generate a rotational force, and a second fan 122*b* configured to be rotated by the blower motor 122*a*. The second fan 122*b* may be accommodated by a fan case 122*c*, but is not limited thereto.

The clothes care apparatus 1 may include a second duct 121, and the blower 122 may be installed in the second duct 121. The second duct 121 communicates with the clothes care compartment 11, thereby forming the second circulation flow path 120 configured to allow air to circulate between the clothes care compartment 11 and the second duct 121. The blower 122 may be arranged on the second circulation flow path 120.

The second duct 121 may be formed behind the second airflow inlet 120*a* of the clothes care compartment 11. The second duct 121 may be provided at the upper rear of the clothes care compartment 11, and may include a filter member 60 therein. The second duct 121 may be coupled to the top cover 130 arranged above the clothes care compartment 11. The second duct 121 may be coupled to the top cover 130 and the blower 122 may be installed therein.

The blower 122 arranged inside the second duct 121 may suction the internal air of the clothes care compartment 11 through the second airflow inlet 120*a* and discharge the suctioned air to a second duct outlet 121*b* and the second airflow outlet 120*b*.

The fan case 122*c* may be coupled to a duct bracket 124 provided on the upper surface 10*b* of the clothes care compartment 11. At least one duct hole 124*a* is formed in the duct bracket 124, and the second fan 122*b* is coupled to the at least one duct hole 124*a* to supply air of the second duct 121 to the second airflow outlet 120*b*.

The second duct 121 may be connected to the second airflow inlet 120*a* and the second airflow outlet 120*b* of the clothes care compartment 11. One end of the second duct 121 may be connected to the second air flow inlet 120*a* of the clothes care compartment 11, and the other end of the second duct 121 may be connected to the second air flow outlet 120*b* of the clothes care compartment 11. A second duct inlet 121*a* of the second duct 121 may be connected to the second airflow inlet 120*a* and the second duct outlet 121*b* of the second duct 121 may be connected to the second airflow outlet 120*b*.

The filter member 60 is installed in the second airflow inlet 120*a* of the clothes care compartment 11. The second airflow inlet 120*a* is formed on the rear surface 10*f* of the clothes care compartment 11. A filter member mounting portion 11*c* in which the filter member 60 installed is formed on the rear surface 110*f* of the clothes care compartment 11. The second airflow inlet 120*a* may be formed at a position corresponding to the filter member mounting portion 11*c*.

The internal air of the clothes care compartment 11 flows into the second duct 121, and then filtered by the filter member 60 of the second air flow inlet 120*a*. Dust and odor in the air flowing into the second duct 121 may be filtered out by the filter member 60. The air filtered by the filter member 60 may be discharged to the second duct outlet 121*b* and the clothes support member 110 by the blower 122. The filter member 60 may include a dust collecting filter (not shown) for removing dust or a means for deodorization.

The clothes care compartment 11 starts the clothes care after the clothes are hung on the clothes support member 110 and the door 20 is closed. In this case, in the clothes care compartment 11, air may be circulated along the first circulation flow path 39 and the second circulation flow path 120.

The air passing through the blower 122 may move to a guide flow path 130*a* formed in the top cover 130. The guide flow path 130*a* is a part of the second circulation flow path 120. The guide flow path 130*a* may correspond to a part of a blowing flow path 150 configured to guide the airflow, which is supplied from the blower 122, to the clothes, and the guide flow path 130*a* may be formed by the top cover 130 and the upper surface 10*b* of the main body 10.

The clothes care apparatus 1 may include the nozzle 140 configured to guide air introduced into the guide flow path 130*a* to the clothes hung on the clothes support member 110. The nozzle 140 may be disposed on the upper surface 10*b* of the main body 10. The nozzle 140 may include a plurality of nozzles 140.

Particularly, the plurality of nozzles 140 may be arranged side by side on a nozzle plate 141 so as to penetrate the nozzle plate 141, and the nozzle plate 141 may form a part of the upper surface 10*b* of the clothes care compartment 11. FIGS. 4 to 6 illustrate that three nozzles 140 are provided as three clothes support members 110 are provided, but the number of clothes support members 110 and nozzles 140 is not limited thereto. Therefore, the number of clothes support members 110 and nozzles 140 may vary as needed.

One end of the nozzle 140 may be connected to the second duct outlet 121*b* formed on an upper surface of the nozzle plate 141 and the other end of the nozzle 140 may be connected to the second airflow outlet 120*b* formed on a lower surface of the nozzle plate 141. The nozzle 140 includes a nozzle surface 142 provided between the one end thereof and the other end thereof and configured to connect the second duct outlet 121*b* to the second airflow outlet 120*b*. Accordingly, an opening formed at the one end of the nozzle 140 may correspond to the second duct outlet 121*b*, and an opening formed at the other end of the nozzle 140 may correspond to the second airflow outlet 120*b*.

The clothes support member 110 may be removably coupled to the nozzle plate 141 to allow the second airflow outlet 120*b* to communicate with the air supply port 111.

Particularly, the clothes support member 110 may be removably coupled to a coupling portion 143 provided on the nozzle plate 141. A pair of coupling portions 143*a* and 143*b* may be provided in a single nozzle 140, the coupling portion 143 may be provided around the second airflow outlet 120*b*, and an inner surface of the coupling portion 143 may be formed by extending the nozzle surface 142. The nozzle 140 may include the pair of coupling portions 143 and the nozzle surface 142.

A protrusion 144 may be provided at a lower end of each of the pair of coupling portions 143. That is, the protrusion 144 may be provided as a pair.

A first fastening portion 114 corresponding to the coupling portion 143 and having a groove shape to be coupled to the protrusion 144 may be provided at an upper end of the clothes support member 110. The first fastening portion 114 may be provided in the shape of a groove along the upper outer surface of the clothes support member 110. As the protrusion 144 of the coupling portion 143 is coupled to the first fastening portion 114 of the clothes support member 110, the clothes support member 110 may be removably coupled to one end of the nozzle 140.

The clothes support member 110 may be removably coupled to the coupling unit by moving in a horizontal direction. Particularly, the clothes support member 110 may be pushed horizontally from the front to the rear of the coupling portion 143 to allow the protrusion 144 of the coupling portion 143 to slide on the first fastening portion 114 of the clothes support member. Accordingly, the clothes support member 110 may be coupled to the coupling portion 143 so as to correspond the second airflow outlet 120*b* to the air supply port 111 arranged between the pair of the coupling portions 143.

The pair of coupling portions 143 shown in FIG. 6 are provided on the left and right sides of the second airflow outlet 120*b*, but is not limited thereto. The pair of coupling portions 143 may be provided on the front and rear side of the second airflow outlet 120*b*, respectively and thus the clothes support member 110 may be pushed from left to right or pushed from right to left.

By pulling the clothes support member 110, which is coupled to the coupling portion 143, from a direction opposite to a coupling direction, the first protrusion 144 may slide from the first fastening portion 114. After the first protrusion 144 is taken out of the first fastening portion 114, the clothes support member 110 may be separated from the coupling portion 143.

However, it is not limited thereto. For example, the coupling portion 143 may be formed of a material having excellent resilience and then integrally with the nozzle plate 141. Alternatively, the coupling portion 143 may be formed with a hinge and provided on the nozzle plate 141. Therefore, the clothes support member 110 may be pushed from a lower side to an upper side and then coupled to the coupling portion 143.

Particularly, the clothes support member 110 may be pushed between the pair of coupling portions 143*a* and 143*b* in such a way that the second airflow outlet 120*b* disposed between the pair of coupling portions 143*a* and 143*b* corresponds to the air supply port 111 at the upper end of the clothes support member 110.

Until the protrusion 144 is inserted into the first fastening portion 114, a gap between the pair of coupling portions 143*a* and 143*b* may be wider than before the clothes support member 110 is pushed. In response to inserting the protrusion 144 into the first fastening portion 114, the gap between the pair of coupling portions 143*a* and 143*b* may be restored to the state before the clothes support member 110 is pushed, and thus the clothes support member 110 may be coupled to the coupling portion 143.

In response to pulling the clothes support member 110 downward in a coupled state, the protrusion 144 may come out from the first fastening portion 114, and the clothes support member 110 may start to be separated from the coupling portion 143 in a state in which the pair of coupling portions 143*a* and 143*b* are open. In response to completion of the separation, the coupling portion 143 may be restored to a state in which the clothes support member 110 is not present.

The second airflow outlet 120*b*, through which air guided by the nozzle 140 is discharged, may be formed to be greater than the air supply port 111 of the clothes support member 110. Accordingly, some of the air discharged through the second airflow outlet 120*b* may be discharged to the inside of the clothes support member 110 through the air supply port 111, and some of the remaining air may be discharged to the outside of the air supply port 111 and then discharged to the outside of the clothes support member 110.

However, it is not limited thereto. Alternatively, the second airflow outlet 120*b* may have the same size as the air supply port 111, or the air supply port 111 may have a larger size than the second airflow outlet 120*b*. Therefore, all of the air discharged through the second airflow outlet 120*b* may be discharged to the outside of the clothes support member 110 through the air supply port 111.

Particularly, the shape of the second airflow outlet 120*b* and the air supply port 111 may include a shape in which the top and bottom are semicircular and the two semicircles are connected by tangent lines extending from opposite ends of the semicircle. That the second airflow outlet 120*b* is formed to be larger than the air supply port 111 means that an outer periphery of the air supply port 111 may be disposed inside an outer periphery of the second airflow outlet 120*b*. Similarly, that the second airflow outlet 120*b* and the air supply port 111 have the same size means that the outer periphery of the second airflow outlet 120*b* may be arranged to match the outer periphery of the air supply port 111.

Figure 8:
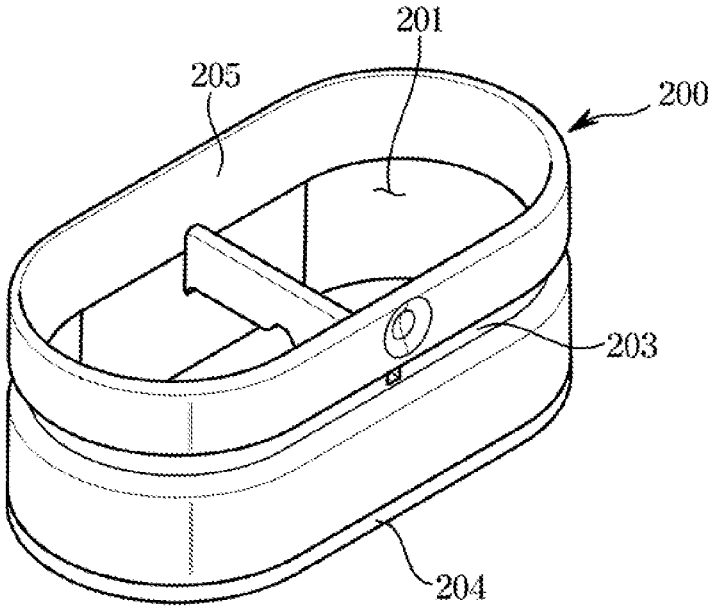
FIG. 8 is a view illustrating a blocking member disposed in the clothes care apparatus shown in FIG. 1.
Figure 9:
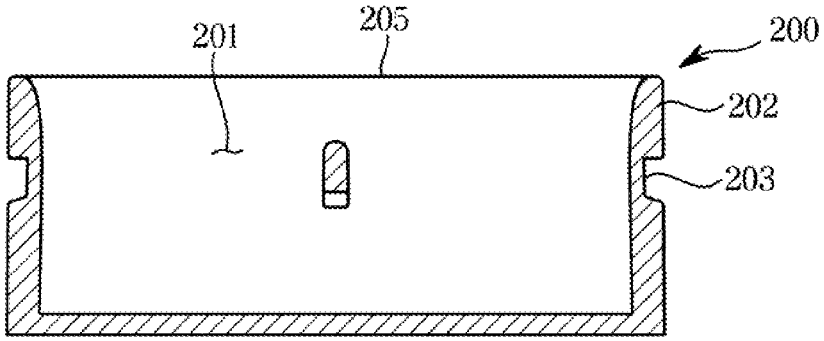
FIG. 9 is a cross-sectional view illustrating a cross-section of the blocking member shown in FIG. 8.
Figure 10:
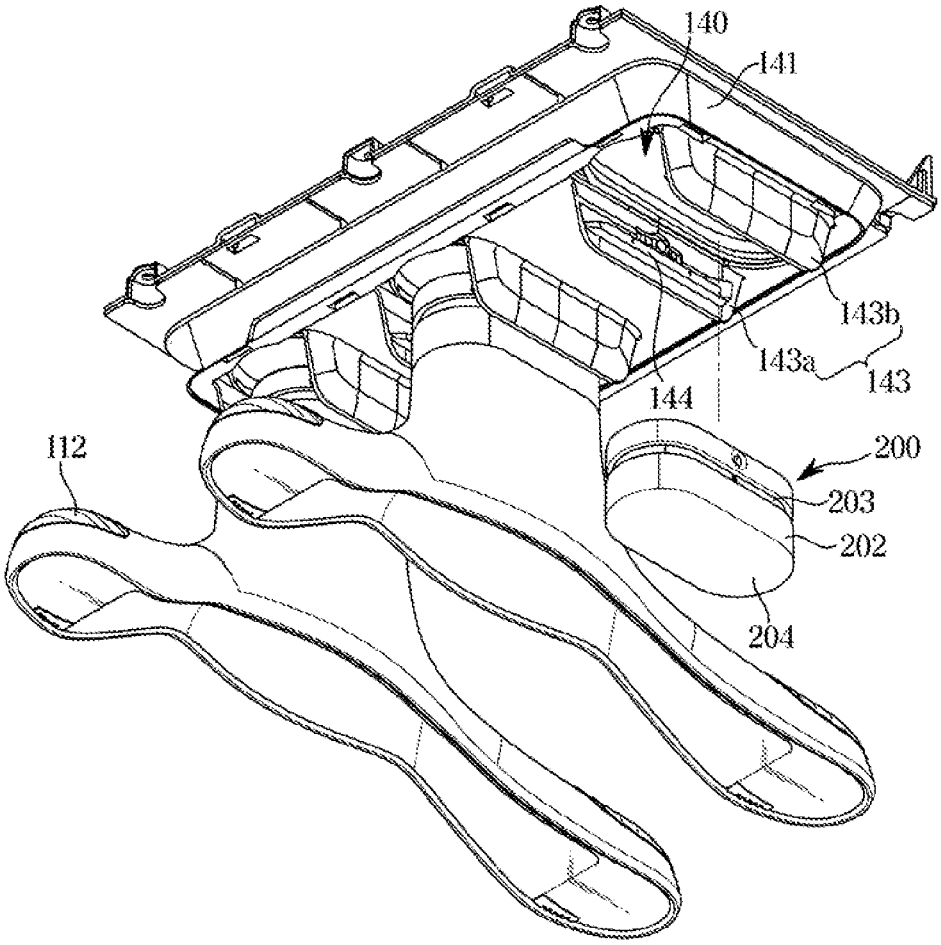
FIG. 10 is an exploded view illustrating the blocking member disposed in the clothes care apparatus shown in FIG. 1.

FIG. 8 is a view illustrating a blocking member disposed in the clothes care apparatus shown in FIG. 1. FIG. 9 is a cross-sectional view illustrating a cross-section of the blocking member shown in FIG. 8. FIG. 10 is an exploded view illustrating the blocking member disposed in the clothes care apparatus shown in FIG. 1.

Referring to FIGS. 8 to 10, the clothes care apparatus 1 includes a blocking member 200 disposed on the blowing flow path 150 configured to allow an airflow formed by the blower 122 to flow into the clothes.

The blocking member 200 may include a body 202 in which a hollow portion 201 forming a part of the blowing flow path 150 is formed and on which a second fastening portion 203 is provided, and a blocking cover 204 provided on a lower end of the body 202 so as to block a flow of air.

Particularly, the body 202 may have a tubular shape in which the hollow portion 201 is formed, and may be provided to surround the blowing flow path 150.

A shape of an upper cross section of the hollow portion 201 may include the same shape as the shape of the second airflow outlet 120*b*. That is, the outer periphery of the upper cross section of the hollow portion 201 may include a shape in which the top and bottom are semicircular and the two semicircles are connected by tangent lines extending from opposite ends of the semicircle. The hollow portion 201 may be provided in such a way that a center line of the hollow portion 201 is perpendicular to the second airflow outlet 120*b*, or the hollow portion 201 may be provided in such a way that an outer periphery of the cross section of the hollow portion 201 may have the same shape at different heights of the hollow portion 201.

However, it is not limited thereto, and the outer periphery of the upper cross section of the hollow portion 201 may include another shape corresponding to the shape of the second airflow outlet 120*b*. In addition, the hollow portion 201 may be provided in such a way that the center line of the hollow portion 201 is inclined to the second airflow outlet 120*b*, or the outer periphery of the cross-section of the hollow portion 201 may have different shapes at different heights of the hollow portion 201.

The upper cross section of the hollow portion 201 may be formed to be greater than or equal to the second airflow outlet 120*b*. That the upper cross section of the hollow portion 201 is formed larger than the second airflow outlet 120*b* means that the outer periphery of the second airflow outlet 120*b* may be disposed inside the outer periphery of the upper cross section of the hollow portion 201. Similarly, that the second airflow outlet 120*b* and the upper cross section of the hollow portion 201 have the same size means that the outer periphery of the second airflow outlet 120*b* may be arranged to match the outer periphery of the upper cross section of the hollow portion 201.

The blocking member 200 may be removably coupled to the coupling portion 143 to allow the hollow portion 201 to communicate with the second airflow outlet 120*b*.

Particularly, the body 202 of the blocking member 200 may be provided with the second fastening portion 203 configured to be removably coupled to the coupling portion 143. The second fastening portion 203 may be provided in the form of a groove along the outer surface of the body 202 like the first fastening portion 114, and in the same manner as the first fastening portion 114, the second fastening portion 203 may be separated from and coupled to the coupling portion 143.

A blocking cover 204 in a plate-shape is provided at a lower end of the body 202 of the blocking member 200. Particularly, the blocking cover 204 may be provided at the lower end of the body 202 and formed integrally with the body 202. That is, the hollow portion 201 is provided in the inside of the blocking member 200 and an opening 205 configured to communicate with the hollow portion 201 is provided at one end of the blocking member 200. The other end of the blocking member 200 is provided in such a way that the hollow portion 201 is blocked by the blocking cover 204.

The body 202 of the blocking member 200 may be coupled to the coupling portion 143 in such a way that the outer periphery of the second airflow outlet 120*b* is included in the inside of the outer periphery of the upper cross section of the hollow portion 201 or the outer periphery of the second airflow outlet 120*b* matches the inside of the outer periphery of the upper cross section of the hollow portion 201. Accordingly, the air discharged from the second airflow outlet 120*b* flows to the hollow portion 201, but the air is prevented from flowing into the clothes by the blocking cover 204.

Referring to FIG. 10, the clothes support member 110 may be disposed on two of the three nozzles 140, and the blocking member 200 may be disposed on the other nozzle 140. Similarly, after separating at least one clothes support member 110 while three clothes support members 110 are disposed inside the clothes care compartment 11, the blocking member 200 may be disposed at a position from which the clothes support member 110 is separated. However, it is not limited thereto, and the number of clothes support members 110 and blocking members 200 may vary.

Air, which is discharged through the second airflow outlet 120*b* of the nozzle 140 provided with the blocking member 200 among the plurality of nozzles 140, may not flow to the inside of the clothes and blocked in the hollow portion 201 of the blocking member 200, or flow to the other nozzle 140 in which the blocking member 200 is not provided. Accordingly, loss of airflow may be prevented, and the clothes care may be performed more effectively by distributing more air to the other nozzle 140 on which the clothes support member 110 is disposed.

Figure 11:
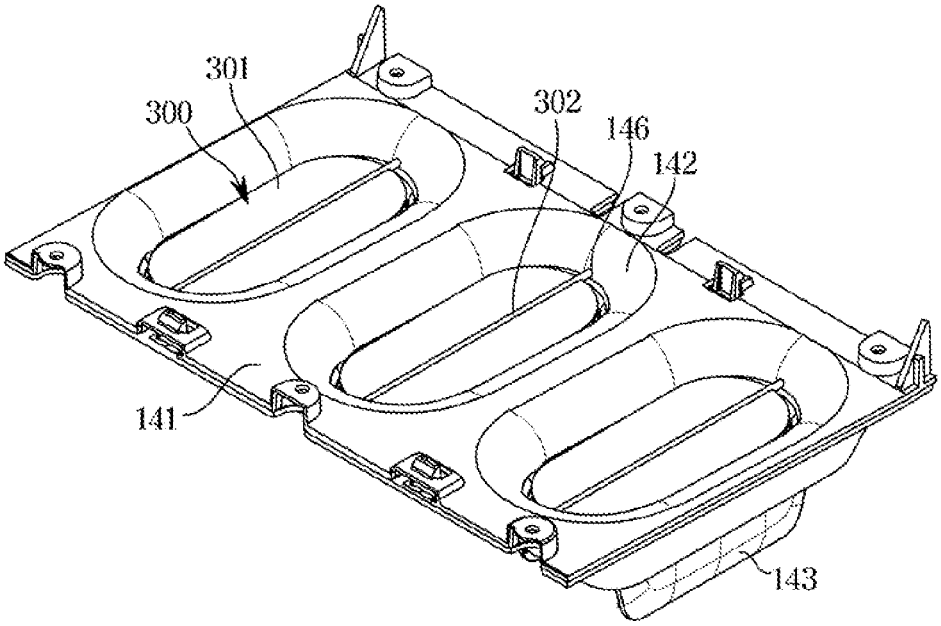
FIG. 11 is a view illustrating a state in which a blocking member of a clothes care apparatus according to another embodiment of the disclosure is closed.
Figure 12:
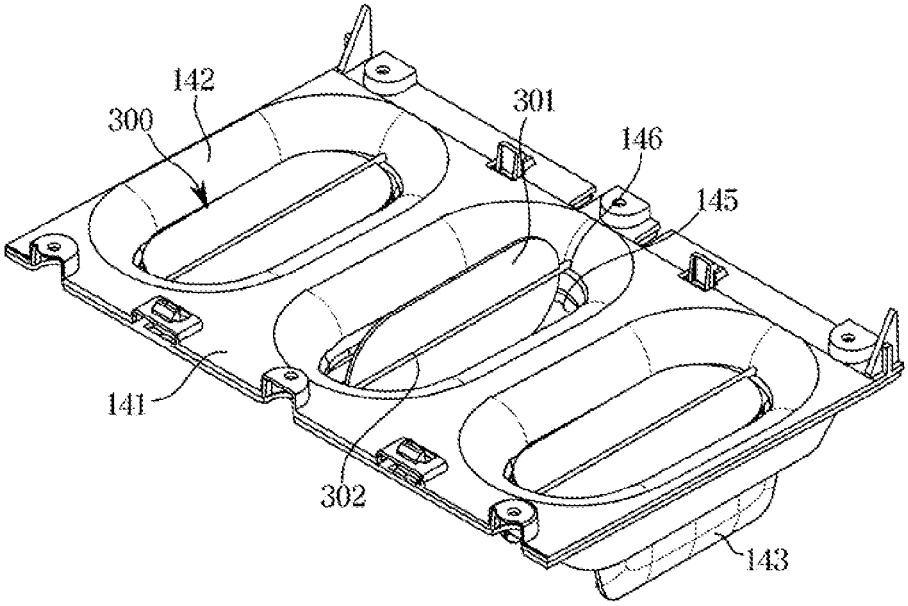
FIG. 12 is a view illustrating a state in which the blocking member shown in FIG. 11 is opened.
Figure 13:
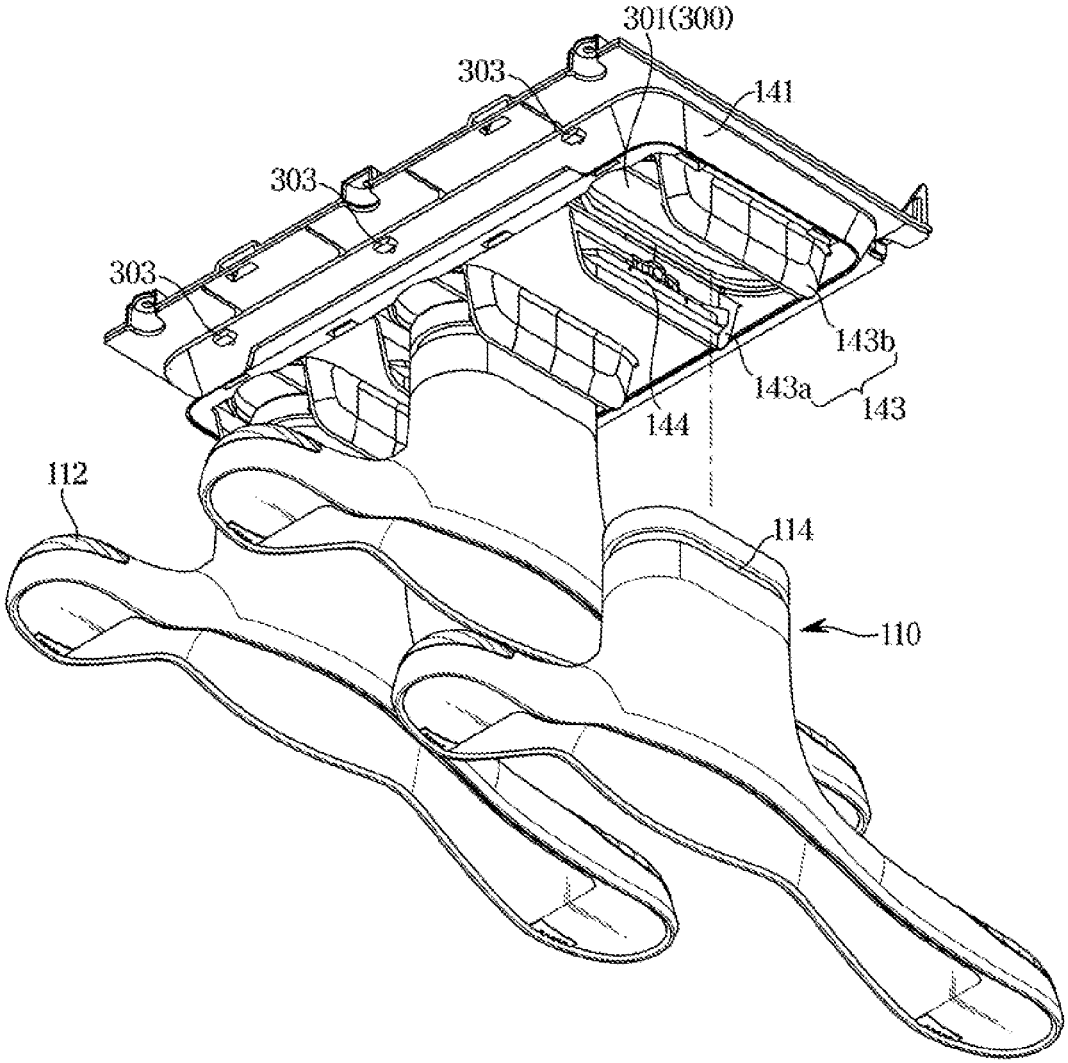
FIG. 13 is an exploded view illustrating a part of a nozzle plate, in which the blocking member shown in FIG. 11 is provided, and a clothes support member.

FIG. 11 is a view illustrating a state in which a blocking member of a clothes care apparatus according to another embodiment of the disclosure is closed. FIG. 12 is a view illustrating a state in which the blocking member shown in FIG. 11 is opened. FIG. 13 is an exploded view illustrating a part of a nozzle plate, in which the blocking member shown in FIG. 11 is provided, and a clothes support member.

Hereinafter descriptions of parts the same as the above description will be omitted.

Referring to FIGS. 11 to 13, a blocking member 300 may be provided on a first flow path 145 provided to penetrate a nozzle plate 141 and provided to form a part of a blowing flow path 150. One end of the first flow path 145 may communicate with a second airflow outlet 120*b*, and the other end of the first flow path 145 may communicate with a second duct outlet 121*b*. A side surface of the first flow path 145 may be covered by a nozzle surface 142. In other words, the first flow path 145 may be provided in the inside of the nozzle 140.

The blocking member 300 may include a plate-shaped blocking cover 301 and may be rotatably provided on the nozzle surface 142.

The blocking member 300 includes a rotating shaft 302, and the rotating shaft 302 is fixed to a center of the blocking cover 301. The rotating shaft 302 is provided on the blocking cover 301 in a direction from the front to the rear of the clothes care apparatus 1 and may be provided in parallel with an upper or lower surface of the nozzle plate 141.

However, it is not limited thereto. In order to block the first flow path 145 in response to the blocking member 300 being stopped at a certain position, the rotating shaft 302 may be provided in a direction different from the direction from the front to the rear of the clothes care apparatus 1 or the rotating shaft 302 may be provided so as not to be parallel to the upper or lower surface of the nozzle plate 141.

The blocking cover 301 may have the same shape as an outer periphery formed by the nozzle surface 142 at a height at which the blocking member 300 is disposed. In other words, the blocking member 300 may be provided to allow the outer periphery of the blocking cover 301 to be in contact with the nozzle surface 142. The blocking cover 301 of the clothes care apparatus 1 shown in FIG. 11 is a shape in which the top and bottom are semicircular and the two semicircles are connected by tangent lines extending from opposite ends of the semicircle, but the shape is not limited thereto. The blocking cover 301 may have a different shape corresponding to the outer periphery formed by the nozzle surface 142 at a height at which the blocking member 300 is disposed.

A pair of support holes 146 configured to rotatably support the rotating shaft 302 is provided on the nozzle surface on the front side of the clothes care apparatus 1 and on the nozzle surface on the rear side of the clothes care apparatus 1. Opposite ends of the rotating shaft 302 is inserted and rotatably fixed to the pair of support holes 146.

The support hole 146 formed on the nozzle surface 142 of the front side of the clothes care apparatus 1 may pass through the nozzle plate 141, and one end of the rotating shaft 302 may pass through the support hole 146 passing through the nozzle plate 141. One end of the rotating shaft 302 may pass through the support hole 146 and may be exposed to the outside from the front surface of the nozzle plate 141. A handle 303 may be provided at one end of the rotating shaft 302 exposed to the outside.

In response to a rotation of the handle 303, the blocking cover 301 fixed to the rotating shaft 302 may be rotated, thereby blocking or opening the first flow path 145. Accordingly, without separating the clothes support member 110, it is possible to block the airflow and distribute the airflow to the other nozzle 140 by rotating the blocking member 300.

Figure 14:
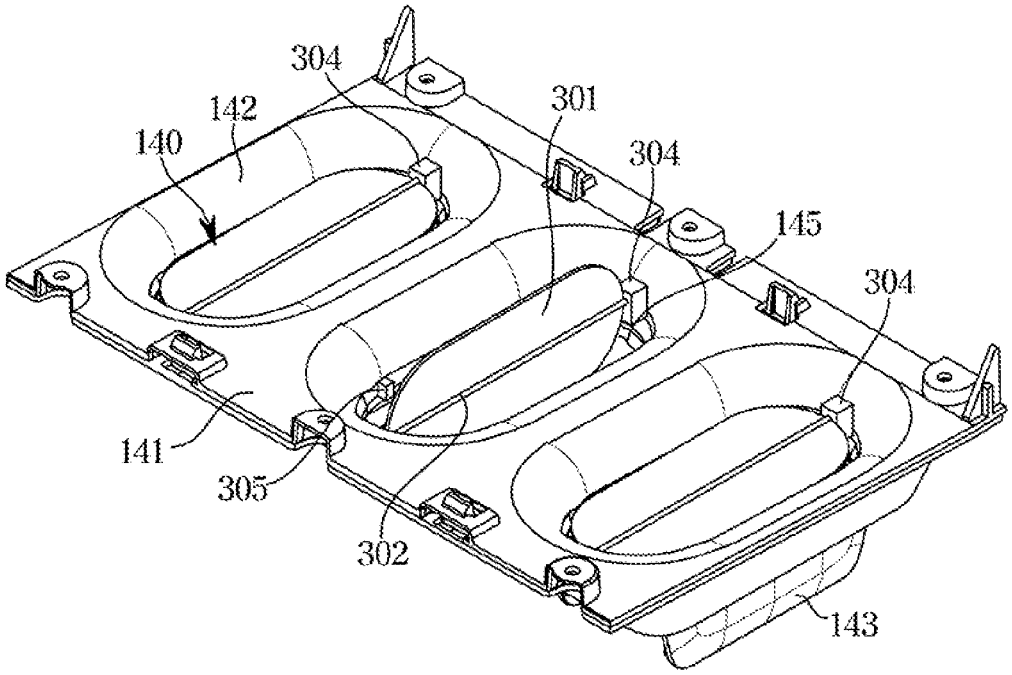
FIG. 14 is a view illustrating a blocking member of a clothes care apparatus according to another embodiment of the disclosure.
Figure 15:
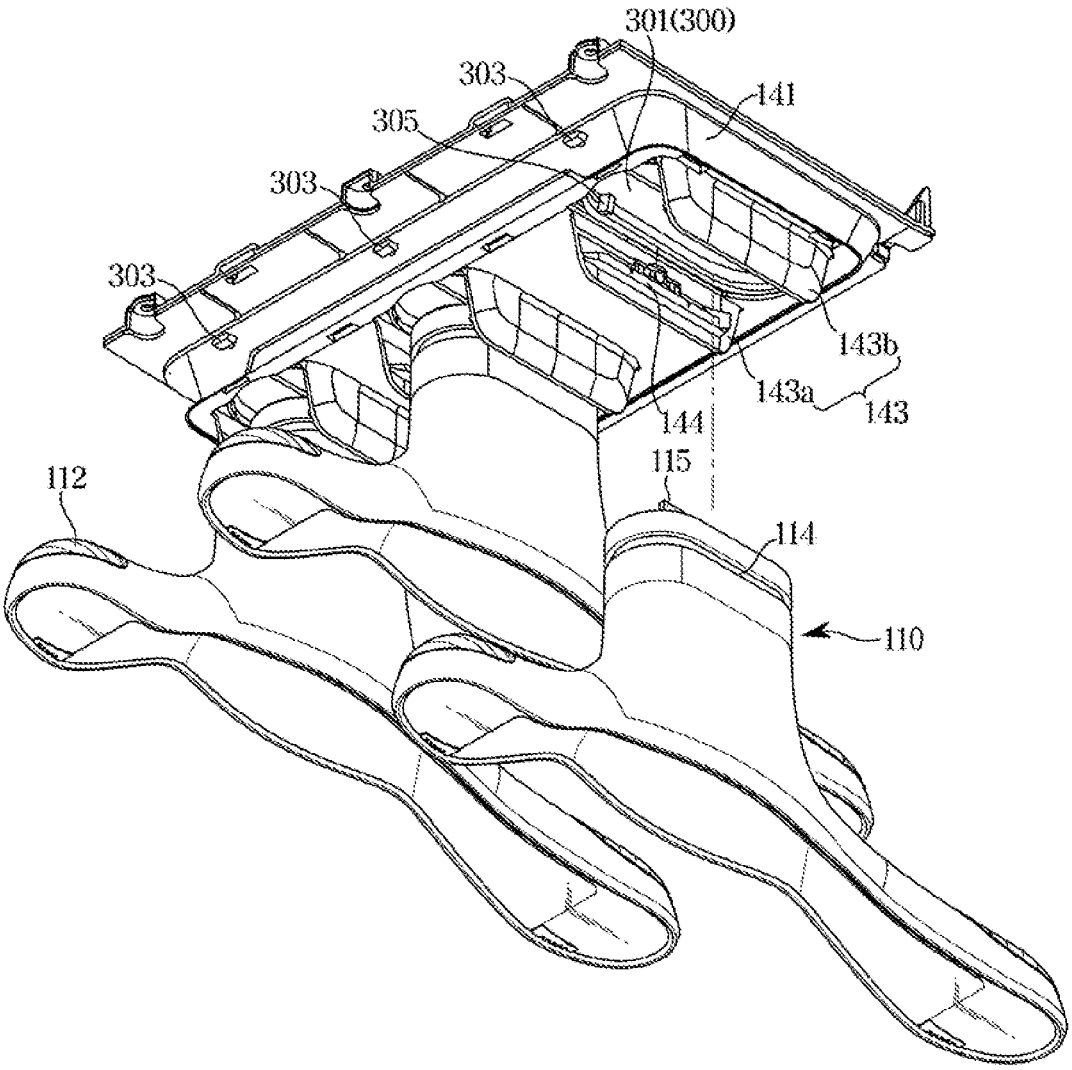
FIG. 15 is a view illustrating the blocking member and a clothes support member of the clothes care apparatus shown in FIG. 14.
Figure 16:
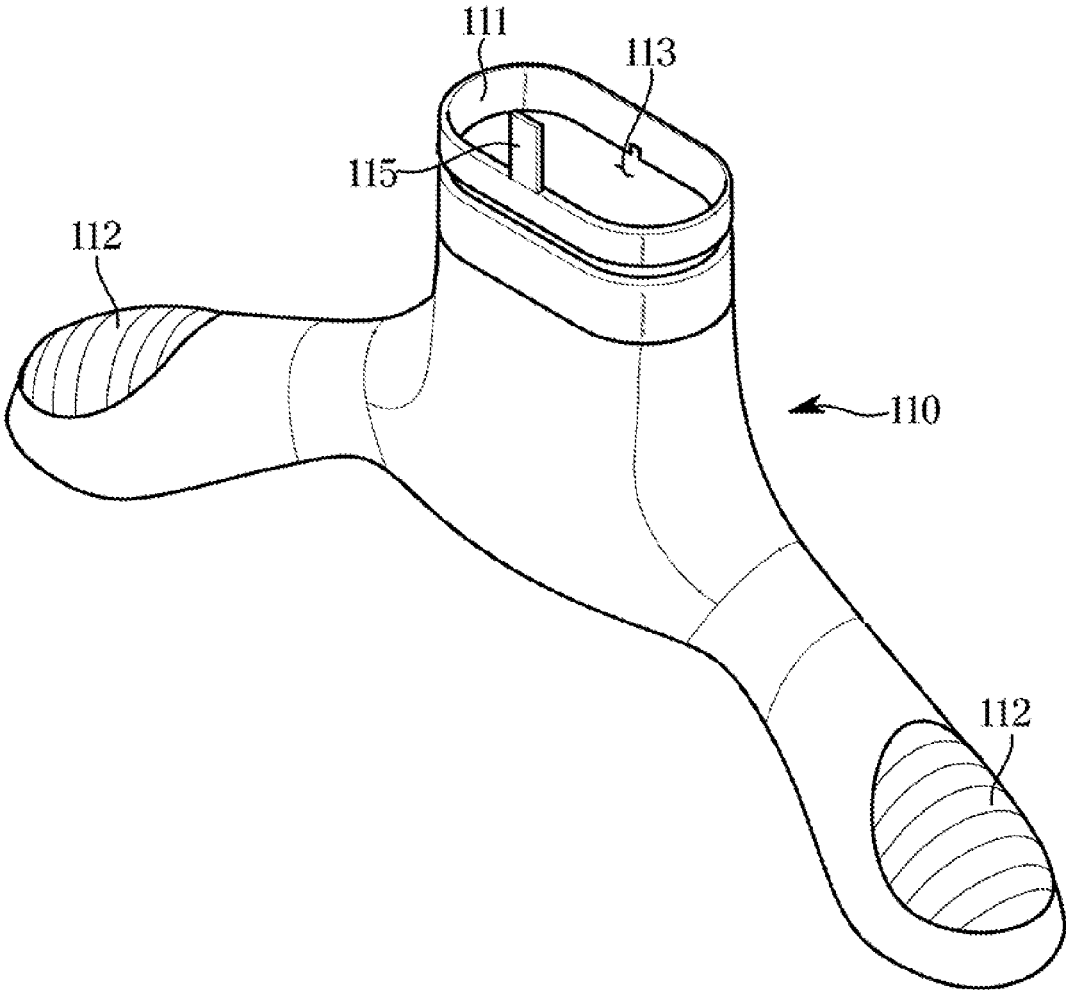
FIG. 16 is a view illustrating the clothes support member shown in FIG. 15.

FIG. 14 is a view illustrating a blocking member of a clothes care apparatus according to another embodiment of the disclosure. FIG. 15 is a view illustrating the blocking member and a clothes support member of the clothes care apparatus shown in FIG. 14. FIG. 16 is a view illustrating the clothes support member shown in FIG. 15.

Hereinafter descriptions of parts the same as the above description will be omitted.

Referring to FIGS. 14 to 16, in a clothes care apparatus 1, a torsion device 304 configured to apply a torque to a rotating shaft 302 to rotate the rotating shaft 302 may be provided on a nozzle surface 142.

One end of the rotating shaft 302 located on the nozzle surface 142 on the rear side of the clothes care apparatus 1 may be coupled to the torsion device 304. The torsion device 304 may rotatably support the rotating shaft 302. The torsion device 304 may include a conventional torsion coil spring or the like configured to apply a rotational force to the rotating shaft 302. However, it is not limited thereto.

Particularly, the torsion device 304 may be provided to apply a torque to the rotating shaft 302, and at the lower end of the nozzle 140, a stopper 305 disposed under the blocking member 300 to stop the blocking member 300 may be provided. A rotation protrusion 115 configured to press the blocking member to rotate the blocking member 300 in a direction opposite to a direction, in which the torsion device 304 rotates the blocking member 300, may be provided at an upper end of the clothes support member 110.

A first fastening portion 114 may be provided on the upper end of the clothes support member 110, and the first fastening portion 114 may be pushed upward from the lower side to be removably coupled to the coupling portion 143.

Therefore, in response to coupling the clothes support member 110 to the coupling portion 143 of the nozzle 140, the rotation protrusion 115 pushes the blocking cover 301 from the lower side to the upper side, and thus the blocking member 300 is rotated to a position for opening the first flow path 145. In response to separating the clothes support member 110 from the coupling portion 143 of the nozzle 140, the rotation protrusion 115 is removed, and the blocking member 300 is rotated in a direction opposite to a direction in which the clothes support member 110 is coupled by the torsion device 304. Accordingly, the blocking member 300 in a rotation state is stopped by the stopper 305 and the blocking member 300 blocks the first flow path 145.

However, it is not limited thereto. The clothes support member 110 provided with the first fastening portion may be coupled by being pushed horizontally from the front to the rear of the coupling portion 143. The rotation protrusion 115 may be provided as a conventional spring hinge and thus the rotation protrusion 115 may be folded inside the clothes support member 110 until the clothes support member 110 is coupled to the coupling portion 143. In response to coupling the clothes support member 110 to the coupling portion 143, the rotation protrusion 115 may protrude on the upper end of the clothes support member 110, and by the rotation protrusion 115, the blocking member 300 may be rotated to a position for opening the first flow path 145.

As mentioned above, without an additional work of coupling the blocking member 200 or rotating the blocking member 300 by hand, the clothes support member 110 is separated and at the same time, the blocking member 300 automatically blocks the blowing flow path 150. Accordingly, it is possible to prevent loss of the airflow and to distribute the airflow.

Figure 17:
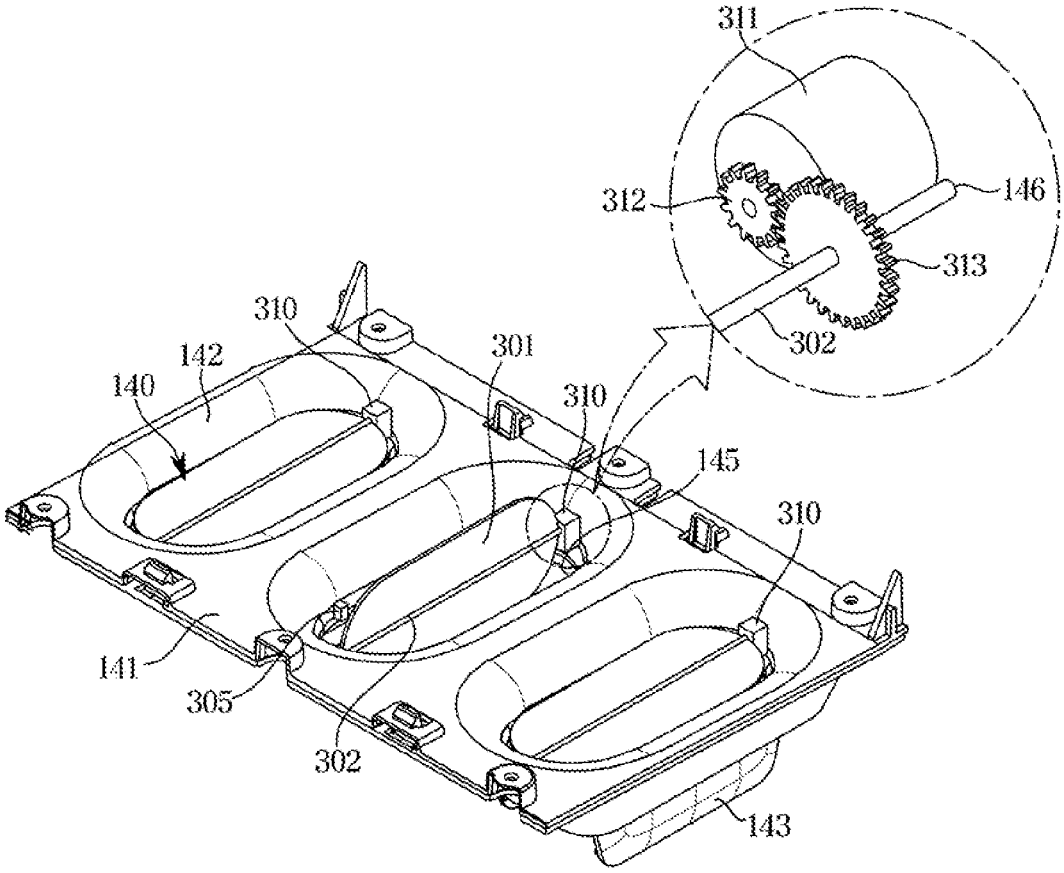
FIG. 17 is a view illustrating a blocking member and an inside of a rotating device of a clothes care apparatus according to another embodiment of the disclosure.

FIG. 17 is a view illustrating a blocking member and an inside of a rotating device of a clothes care apparatus according to another embodiment of the disclosure.

Hereinafter descriptions of parts the same as the above description will be omitted.

Referring to FIG. 17, a clothes care apparatus 1 may include a rotating device 310 provided on a nozzle surface 142 and configured to rotate a rotating shaft 302 of a blocking member 300.

The rotating device 310 may include a motor 311 therein, and a gear train 312 and 313 configured to transmit power of the motor 311 to the rotating shaft 302 by connecting the motor 311 to the rotating shaft 302.

The rotating device 310 may be provided on each of a plurality of nozzles. Particularly, the rotating device 310 may be provided on a nozzle surface 142 of the rear side of the clothes care apparatus 1.

However, it is not limited thereto, and the rotating device 310 may be provided at a different position of the clothes care apparatus 1 so as to transmit power of the motor 311 to the rotating shaft 302 by using a conventional bevel gear, a worm gear, or a belt.

Each rotating device 310 may be electronically controlled by a controller (not shown), and each rotating device 310 may be driven independently, and two or more may be driven simultaneously.

A stopper 305 may be provided at a lower end of the nozzle 140 to stop the rotation of the blocking member 300. However, it is not limited thereto, and the stopper 305 may be omitted.

Because the rotating device 310 is electronically controlled, a handle 303 may be omitted. However, it is not limited thereto, and the handle 303 may be provided.

The motor 311 of the rotating device 310 controlled by a controller (not shown) may be rotated in both directions. The motor 311 may rotate the blocking member 300 toward one direction to block the first flow path 145, and the motor 311 may rotate the blocking member 300 toward a direction opposite to the one direction to open the first flow path 145.

However, it is not limited thereto. For example, in a case of omitting the stopper 305 at the lower end of the nozzle 140, the motor 311 may be rotated only in one direction, but the first flow path 145 may be opened and closed by adjusting a degree of rotation.

The controller (not shown) may include a controller configured to perform a remote control.

As mentioned above, without an additional work of separating the clothes support member 110 or rotating the blocking member 300 by hand, the blocking member 300 blocks the blowing flow path 150. Accordingly, it is possible to prevent loss of the airflow and to distribute the airflow.

Figure 18:
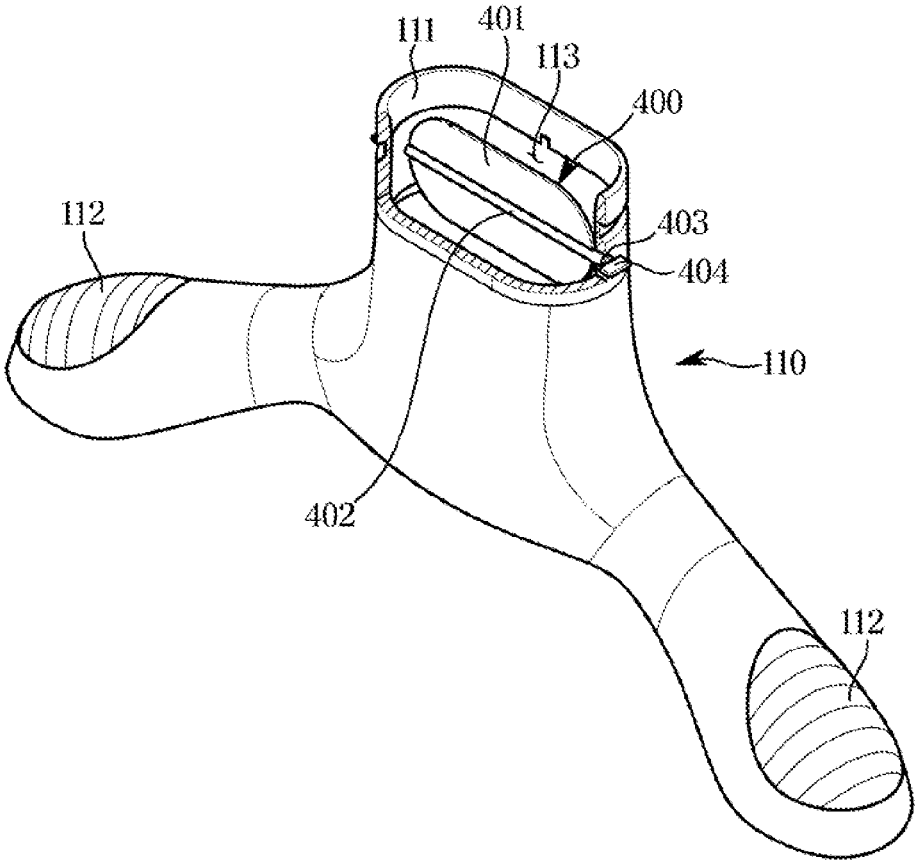
FIG. 18 is a view illustrating a clothes support member of a clothes care apparatus according to another embodiment of the disclosure.

FIG. 18 is a view illustrating a clothes support member of a clothes care apparatus according to another embodiment of the disclosure.

Hereinafter descriptions of parts the same as the above description will be omitted.

Referring to FIG. 18, a blocking member 400 is provided on a second flow path 113 corresponding to an internal flow path 113 of the clothes support member 110 provided inside a clothes support member 110 and configured to form a part of a blowing flow path 150.

As described above, the clothes support member 110 may include a first fastening portion 114. As the coupling portion 143 is coupled to the first fastening portion 114, the clothes support member 110 may be removably coupled to the nozzle plate 141 to communicate with a nozzle 140.

The blocking member 400 may include a plate-shaped blocking cover 401 and may be rotatably provided in the inside of an upper end of the clothes support member 110. The blocking member 400 includes a rotating shaft 402, and the rotating shaft 402 is fixed to a center of the blocking cover 401.

A shape of the blocking cover 401 may have the same shape as a cross-section of the second flow path 113 at a position, in which the blocking member 400 is disposed, to block the second flow path 113 according to a rotation of the blocking member 400. In other words, the blocking cover 401 may be provided in such a way that an outer periphery of the blocking cover 401 comes into contact with an inner surface of the clothes support member 110, which surrounds the second flow path 113, in response to the rotation of the blocking cover 401.

A pair of support holes 403 may be provided on an inner surface of the upper end of the clothes support member 110 so as to rotatably support the rotating shaft 402.

Any one of the pair of support holes 403 may pass through the clothes support member 110, and one end of the rotating shaft 402 passes through the support hole 403 to be exposed to the outside from one surface of the clothes support member 110. A handle 404 may be provided at one end of the rotating shaft 402 exposed to the outside.

In response to a rotation of the handle 404, the blocking cover 401 fixed to the rotating shaft 402 may be rotated, thereby blocking or opening the second flow path 113. Accordingly, without separating the clothes support member 110, it is possible to block the airflow by rotating the blocking member 400 and to distribute the airflow to the other nozzle 140.

As is apparent from the above description, the flow path may be formed in the clothes support member to allow air, which is discharged from the nozzle, to be supplied to the inside of clothes through the flow path of the clothes support member.

By using the blocking member, the clothes care apparatus may distribute an airflow to allow the airflow to be discharged to the clothes support member that requires the airflow among the plurality of clothes support members.

By using the blocking member, the clothes care apparatus may prevent air from flowing into the clothes support member that is not used among the plurality of clothes support members, and thus the clothes care apparatus may reduce the loss of airflow provided to the clothes support member.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A clothes care apparatus comprising:

a main body including a clothes care compartment to accommodate clothes;

a blower provided in the main body and configured to generate an airflow;

a blowing flow path configured to guide the airflow generated from the blower toward the clothes care compartment;

a nozzle plate formed along an upper surface of the clothes care compartment;

a plurality of nozzles disposed along the blowing flow path, the plurality of nozzles respectively including an airflow outlet configured to discharge the airflow guided by the blowing flow path to an inside of the clothes care compartment, one end of each of the plurality of nozzles connected to a duct outlet formed on an upper surface of the nozzle plate and the other end of each of the plurality of nozzles connected to a lower surface of the nozzle plate; and at least one blocking member disposed along the blowing flow path to block the airflow from being discharged to the inside of the clothes care compartment.

2. The clothes care apparatus of claim 1, wherein the at least one blocking member comprises:

a body comprising a hollow portion disposed on the blowing flow path, the body being coupleable to and decoupleable from the plurality of nozzles, and a blocking cover configured to cover the hollow portion of the body so as to block the airflow guided by the blowing flow path from flowing through the blowing flow path.

3. The clothes care apparatus of claim 2, wherein the blocking cover is integrally formed with one end of the body.

4. The clothes care apparatus of claim 1, further comprising:

at least one clothes support member disposed along the blowing flow path, and coupleable to and decoupleable from at least one of the plurality of nozzles, wherein the at least one blocking member is coupled to the at least one of the plurality of nozzles, and at least another clothes support member is coupled to at least another of the plurality of nozzles from which the at least one blocking member is decoupled.

5. The clothes care apparatus of claim 1, wherein the at least one blocking member is rotatably disposed on a nozzle among the plurality of nozzles so as to block the airflow flowing through the blowing flow path.

6. The clothes care apparatus of claim 5, wherein the at least one blocking member comprises a rotating shaft with a handle provided on one end of the rotating shaft, the at least one blocking member being rotatable on the rotating shaft while coupled to the nozzle, wherein the at least one blocking member opens and closes the blowing flow path by being rotated according to a rotation of the handle.

7. The clothes care apparatus of claim 5, wherein the at least one blocking member comprises a rotating shaft rotatably coupled to the nozzle, a torsion device configured to apply a torque to one end of the rotating shaft to allow the at least one blocking member to be rotated.

8. The clothes care apparatus of claim 7, further comprising:

at least one clothes support member disposed on the blowing flow path, the at least one clothes support member being coupleable to and decoupleable from the nozzle among the plurality of nozzles, wherein the torsion device is configured to apply a torque to allow the at least one blocking member to be rotated in one direction, the nozzle further comprises a stopper provided on one end of the nozzle and configured to stop the at least one blocking member from being rotated, and the clothes support member comprises a rotation protrusion configured to press the at least one blocking member to rotate the at least one blocking member to a direction opposite to the one direction in response to coupling the at least one clothes support member to the nozzle.

9. The clothes care apparatus of claim 1, further comprising:

at least one clothes support member disposed on the blowing flow path, and coupleable to and decoupleable from a nozzle among the plurality of nozzles.

10. The clothes care apparatus of claim 9, wherein the at least one blocking member is rotatably disposed on the at least one clothes support member to block the airflow flowing through the blowing flow path.

11. The clothes care apparatus of claim 10, wherein the at least one blocking member comprises a rotating shaft with a handle provided on one end of the rotating shaft, the at least one blocking member being rotatable on the rotating shaft while coupled to the nozzle, wherein the at least one blocking member opens and closes the blowing flow path by being rotated according to a rotation of the handle.

12. A clothes care apparatus comprising:

a main body including a clothes care compartment to accommodate clothes;

a blower provided in the main body and configured to generate an airflow;

a blowing flow path configured to guide the airflow generated by the blower to an inside of the clothes care compartment, the blow flow path includes a first flow path formed in a nozzle plate provided at one side of the clothes care compartment, the nozzle plate including a support hole formed on an outer peripheral surface of the nozzle plate, and a second flow path formed in an inside of a clothes support member coupleable to and decoupleable from the nozzle plate: and a blocking member insertable into the support hole and rotatably disposed on the blowing flow path to block the airflow from being guided to the inside of the clothes care compartment.

13. The clothes care apparatus of claim 12, wherein the blocking member comprises a rotating shaft provided on a center of the blocking member, and the blocking member is rotatable on the nozzle plate to block the first flow path.

14. The clothes care apparatus of claim 13, wherein the rotating shaft is with a handle provided on one end of the rotating shaft, wherein the blocking member opens and closes the first flow path by being rotated according to a rotation of the handle.

15. The clothes care apparatus of claim 13, wherein the blocking member comprises a torsion device provided at one end of the rotating shaft o apply a torque to the rotating shaft so as to allow the blocking member to be rotated.

16. The clothes care apparatus of claim 12, wherein the blocking member comprises a rotating shaft provided on a center of the blocking member, and the blocking member is rotatable in an inside of the clothes support member to block the second flow path.

17. The clothes care apparatus of claim 16, wherein the rotating shaft is provided with a handle on one end of the rotating shaft, wherein the blocking member opens and closes the second flow path by being rotated according to a rotation of the handle.

18. A clothes care apparatus comprising:

a main body including a clothes care compartment;

a blower provided on an outside of the clothes care compartment and configured to generate an airflow;

at least one clothes support member disposed in an inside of the clothes care compartment and provided with a flow path therein;

a nozzle plate including a plurality of openings to allow the airflow generated by the blower to flow into the at least one clothes support member; and at least one blocking member configured to close an opening among the plurality of openings, the at least one blocking member including a groove formed along an outer surface and being coupleable to and decoupleable from the nozzle plate, wherein the at least one clothes support member is coupleable to and decoupleable from the nozzle plate so that while the at least one clothes support member is coupled to the nozzle plate, the airflow is allowed to flow through the opening.

19. The clothes care apparatus of claim 18, wherein the at least one blocking member comprises:

a body comprising a hollow portion configured to be connected to the opening among the plurality of openings, the body coupleable to and decoupleable from the nozzle plate, and a blocking cover configured to block the hollow portion of the body to close the opening among the plurality of openings.

20. The clothes care apparatus of claim 19, wherein the blocking cover is integrally formed with one end of the body.

* * * * *